US010508535B2

(12) United States Patent
Wu

(10) Patent No.: US 10,508,535 B2
(45) Date of Patent: Dec. 17, 2019

(54) METHOD FOR STEERING A WELL PATH PERPENDICULAR TO VERTICAL FRACTURES FOR ENHANCED PRODUCTION EFFICIENCY

(71) Applicant: Schlumberger Technology Corporation, Sugar Land, TX (US)

(72) Inventor: Peter T. Wu, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1315 days.

(21) Appl. No.: 14/528,983

(22) Filed: Oct. 30, 2014

(65) Prior Publication Data

US 2016/0123082 A1 May 5, 2016

(51) Int. Cl.

| | |
|---|---|
| ***E21B 7/06*** | (2006.01) |
| ***E21B 3/00*** | (2006.01) |
| ***E21B 47/024*** | (2006.01) |
| ***E21B 47/022*** | (2012.01) |

(52) U.S. Cl.
CPC ..... *E21B 47/024* (2013.01); *E21B 47/02216* (2013.01)

(58) Field of Classification Search
CPC ..... E21B 47/024; E21B 47/02216
See application file for complete search history.

(56) References Cited

U.S. PATENT DOCUMENTS

| | | | | |
|---|---|---|---|---|
| 6,798,208 | B2 | 9/2004 | Omeragic | |
| 6,924,646 | B2 | 8/2005 | Omeragic | |
| 6,937,021 | B2 | 8/2005 | Rosthal | |
| 2004/0108853 | A1 | 6/2004 | Rosthal | |
| 2004/0245016 | A1* | 12/2004 | Chemali | E21B 44/00 175/25 |
| 2005/0256645 | A1 | 11/2005 | Rabinovich et al. | |
| 2007/0168134 | A1 | 7/2007 | Strack et al. | |
| 2010/0004866 | A1* | 1/2010 | Rabinovich | G01V 3/28 702/7 |
| 2010/0230095 | A1 | 9/2010 | Yin | |
| 2012/0065889 | A1 | 3/2012 | Wu et al. | |
| 2012/0298420 | A1 | 11/2012 | Seydoux et al. | |

(Continued)

FOREIGN PATENT DOCUMENTS

WO 2015089464 A1 6/2015

OTHER PUBLICATIONS

SLIM; "Borehole-image log interpretation and 3D facies modeling in the Mesaverde group, Greater Natural Buttes field, Uinta Basin, Utah", Colorado School of Mines. Arthur Lakes Library, 2007 Spring, 273 pages.*

(Continued)

*Primary Examiner* — Regis J Betsch
*Assistant Examiner* — Jeremy A Delozier

(57) ABSTRACT

A method for drilling a wellbore includes drilling a well along a path substantially along a bedding direction of a selected subsurface formation having at least one substantially vertical fracture therein. A direction of the at least one substantially vertical fracture is determined with respect to a direction of the prior to drilling therethrough. A direction of the path is adjusted so that the well will intersect the at least one substantially vertical fracture substantially perpendicularly to the direction.

19 Claims, 35 Drawing Sheets

(56) References Cited

U.S. PATENT DOCUMENTS

| | | | | |
|---|---|---|---|---|
| 2013/0270009 | A1* | 10/2013 | Logan | E21B 7/046 175/50 |
| 2013/0335092 | A1 | 12/2013 | Wu | |
| 2014/0078288 | A1 | 3/2014 | Wu | |
| 2014/0231072 | A1 | 8/2014 | Samuel et al. | |
| 2015/0276966 | A1 | 10/2015 | Wang et al. | |
| 2016/0124108 | A1 | 5/2016 | Wu | |
| 2016/0282512 | A1 | 9/2016 | Donderici et al. | |
| 2016/0299248 | A1 | 10/2016 | Wu et al. | |

OTHER PUBLICATIONS

Levenberg, "A Method for the Solution of Certain Problems in Least Squares", The Quarterly Journal of and Mechanics Applied Mathematics, vol. 2, 1944, pp. 164-168

Marquardt, "An Algorithm for Least-Squares Estimation of Nonlinear Parameters", Journal of the Society for Industrial and Applied Mathematics, vol. 11, No. 2, 1963, pp. 431-441.

Wu, et al., "Borehole Effects and Correction in OBM with Dip and Anisotropy for Triaxial Induction Tools", SPE 110623—SPE Annual Technical Conference & Exhibition, Anaheim, CA, Nov. 11-14, 2007, 20 pages.

Wu, et al., "Efficient hierarchical processing and interpretation of triaxial induction data in formations with changing dip", SPE-135442-MS, Society of Petroleum Engineers, SPE Annual Technical Conference and Exhibition, Florence, Italy, Sep. 19-22, 2010, 14 pages.

Wu, et al., "Fracture Characterization Using Triaxial Induction Tools", SPWLA-2013-CC, Society of Petrophysicists and Well-Log Analysts, SPWLA 54th Annual Logging Symposium, New Orleans, Louisiana, Jun. 22-26, 2013, 16 pages.

Björck, "Numerical Methods for Least Squares Problems", SIAM: Society for Industrial and Applied Mathematics; 1 edition, ISBN-13: 978-0898713602, Apr. 1996, pp. 339-358.

International Search Report issued in related PCT application PCT/US2015/057943 dated Feb. 3, 2016, 3 pages.

International Preliminary Report on Patentability issued in International Patent application PCT/US2015/057943, dated May 2, 2017, 9 pages.

International Search Report and Written Opinion issued in International Patent application PCT/US2015/057971 dated Jan. 28, 2016, 10 pages.

International Preliminary Report on Patentability issued in International Patent application PCT/US2015/057971, dated May 2, 2017, 6 pages.

Bonner et al., New 2MHz Multiarray Borehole-Compensated Resistivity Tool Developed for MWD Slim Holes, SPE Technical Conference and Exhibition, Dallas, Texas, Oct. 22-25, 1995, 16 pages.

* cited by examiner

Example FMI Image of Vertical Fractures in Horizontal Well

Model of Triaxial Propagation Tool in Horizontal Well Traversing Vertical Fractures at an Angle to the Well Path

METHOD FOR STEERING A WELL PATH PERPENDICULAR TO VERTICAL FRACTURES FOR ENHANCED PRODUCTION EFFICIENCY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure is related to the field of multiaxial electromagnetic induction measurements made in wellbores drilled through subsurface formations. More specifically, the disclosure relates to techniques for characterizing fractures in subsurface formations using response of component measurements from a multiaxial electromagnetic well logging instrument and using such characterization for steering a well path.

Finding the state of fractures in subsurface formations became important following the advent of what is termed "unconventional production", or using wellbores that traverse a formation substantially along its bedding plane to cause the wellbore to intersect large numbers of fractures in such formations, such fractures being inclined or perpendicular to the bedding plane of the formations.

Methods known in the art for detecting and characterizing fractures use, for example, borehole imaging instruments that include small (several centimeter) scale electrical resistivity and/or acoustic detectors disposed in pads placed in contact with the wall of a wellbore. These instruments make very shallow (i.e., lateral depth into the formation from the wellbore wall) measurements with respect to the wellbore wall and produce images of features essentially on the borehole wall. A good image from such instruments often requires that the wellbore is in good mechanical condition, i.e., having a smooth, uninterrupted wall free of cave-ins, washouts, etc. The drilling process itself often introduces many very shallow fractures that may be observable on the image to make it difficult for an interpreter to differentiate naturally occurring, greater lateral extent fractures from shallow, induced fractures.

Methods for using much deeper investigating multiaxial (triaxial) induction measurements to detect and characterize fractures have been introduced more recently. These methods may preferentially detect only those fractures that have substantial lateral extent from the wellbore and therefore may provide a differentiation capability that is lacking when using borehole imaging tools. However, multiaxial induction methods known in the art have proven to be most effective under the conditions of a nearly vertical well detecting near vertical fractures, i.e., the fracture plane and the wellbore axis are substantially parallel. Such methods are adequate for exploratory wells have not proven effective for unconventional production wells which are mostly drilled essentially parallel to the bedding plane of the fractured producing formation and thus at high relative angle between the wellbore axis and the fracture plane.

Very thin fractures having large planar extent filled with electrically non-conductive drilling fluid (e.g., oil based drilling mud—"OBM") may block induced eddy currents from flowing in the formation and could produce significant anomalies in inverted formation parameters compared with those from the same formation without such fractures. The size of the anomaly depends on the formation resistivities (Rh, Rv), the size of the fracture plane, and the relative dip and azimuth between the fracture plane and the layering structure of the formation. If the fracture plane is nearly parallel to the layering structure of the formation, the effects of the fracture on the response of a tri-axial induction logging instrument's measurements may be small. On the other hand, if the fracture plane is perpendicular to the layering structure of the formation the effect of the fracture may dominate the response of such instruments. The most common fracture system encountered in unconventional productions wellbores is substantially horizontally layered formation having substantially vertical fractures. Therefore, a tri-axial induction well logging instrument may be used to detect and characterize at least part of the large vertical fracture system encountered by a wellbore drilled along the bedding plane of such a formation.

U.S. Pat. No. 6,798,208 B2 issued to Omeragic, U.S. Pat. No. 6,924,646 B2 issued to Omeragic and U.S. Pat. No. 6,937,021 B2 issued to Rosthal describe various methods for using electromagnetic induction measurements to estimate fracture orientation. None of the foregoing patents, however, disclose a method to detect the existence of fracture. All three of the foregoing patents demonstrate that if a large planar fracture is present near the wellbore, the fracture azimuth can be computed from certain electromagnetic induction component measurements oriented perpendicular to the fracture plane. However, such technique may be less valuable without the capability of identifying the existence of the fracture first. The algorithms in the foregoing patents compute an orientation which may also be due to dipping (i.e., non-horizontal) electrically anisotropic formations and have nothing to do with fractures. From a practical point of view, it is useful to have a fracture indicator first than to have a means to compute the fracture azimuth assuming a large fracture exists near the wellbore.

Usually, for resistive fractures in a conductive background formation, the triaxial induction instruments' measurements are relatively insensitive to the fracture aperture. This is because fracture planes having sufficient resistivity contrast with respect to the background formation will block the induced eddy currents in a similar manner regardless of the thickness (or fracture aperture) of the resistive fracture. Therefore, 0.1 inch aperture fracture will cause similar triaxial induction instrument responses as those from a 1 inch aperture fracture. A typical resistive fracture disposed in a conductive background formation condition is a result of OBM drilling through low resistivity fractures shale. Under this condition, using techniques known in the art it may be possible detect the location of fractures and their orientation. However, the measurements do not have sufficient sensitivity to infer the aperture of the fractures accurately.

Under the reverse logging condition, namely conductive fractures within resistive background formations such as water based mud (WBM) logging within high resistivity formations such as carbonates, organic shale, lignite or coal beds, the triaxial induction tool will have sufficient sensitivity to infer the aperture of the fractures. Most of the fractures, natural or induced, in petroleum production applications are nearly vertical. "FRACTURE CHARACTERIZATION USING TRIAXIAL INDUCTION TOOLS", Peter Wu, et al., paper D, SPWLA 54th Annual Logging Symposium, New Orleans, La. Jun. 22-26, 2013, discloses a method for obtaining estimation of an effective fracture aperture for a near vertical fracture system encountered near the wellbore using triaxial induction instrument measurements. The foregoing described method exploits the sensitive components of the measured conductivity tensor and inverts for effective fracture aperture using a simple model of uniform anisotropic formation background with a large vertical fracture parameterized by an arbitrary aperture width.

If it is possible to determine the azimuth (directional orientation) of vertical fractures in a formation prior to drilling a well therethrough, it may be possible to adjust the well path to intersect the fractures close to perpendicularly when the fractures are penetrated by the well. Such intersection may enhance productivity of the well.

SUMMARY

A method for drilling a wellbore is described. The method includes drilling a well along a path substantially along a bedding direction of a selected subsurface formation having at least one substantially vertical fracture, determining a direction of the vertical fracture with respect to the drilling direction, and adjusting a direction of the path so that the well will intersect the vertical fracture substantially perpendicularly to the direction.

A system for drilling a wellbore is also described. The system includes a directional drilling device coupled to a drill string having a drill bit at one end, means for determining a direction of fractures in a formation prior to drilling by the drill bit, and means for communicating the determined direction to an operator of the directional drilling device to enable the operator to use the directional drilling device to change a direction of the well path.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1A:
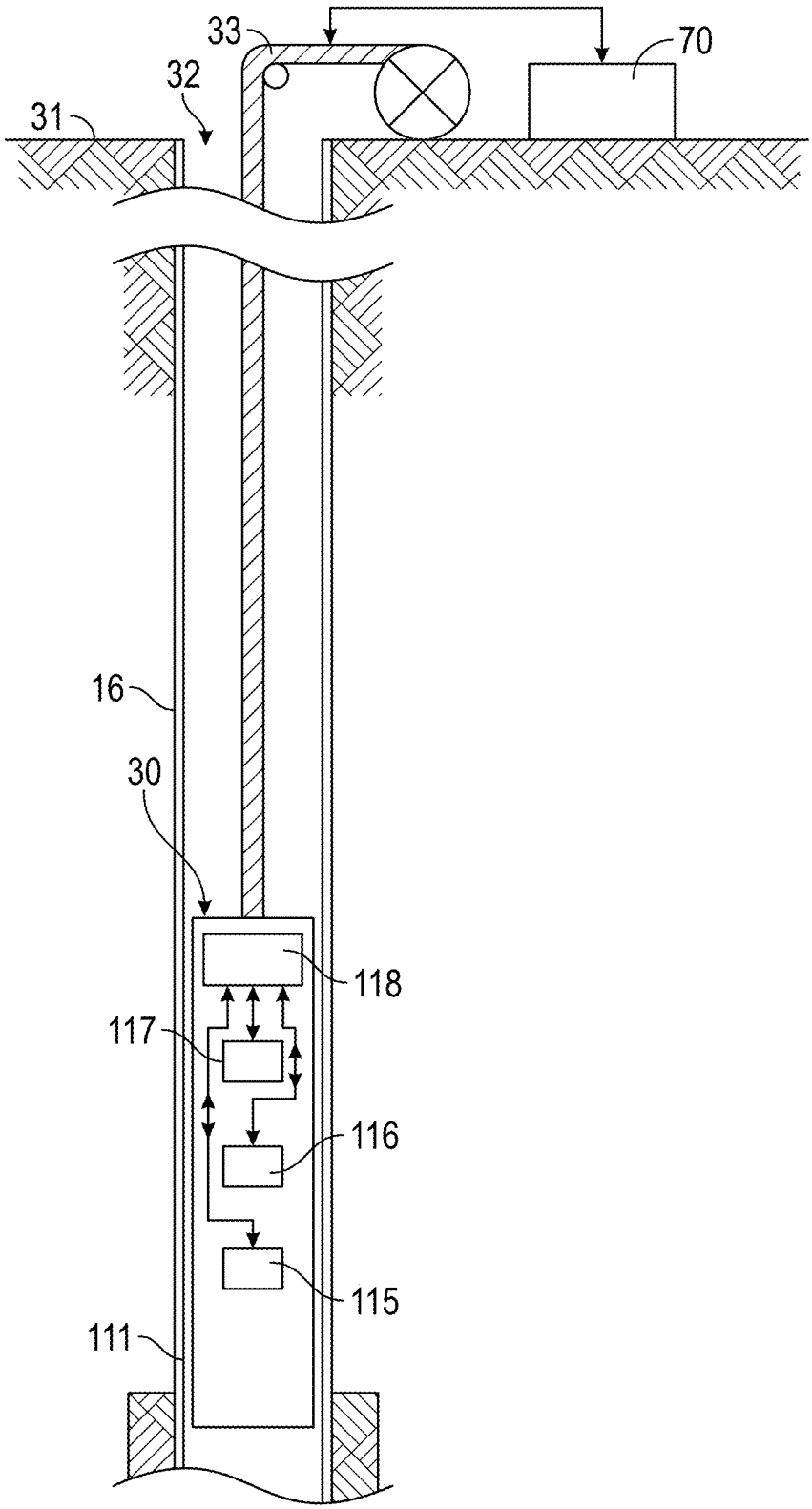
FIG. 1A shows an example wireline conveyed multiaxial electromagnetic well logging instrument disposed in a wellbore drilled through subsurface formations.

FIG. 1A shows an example multi-axial electromagnetic well logging instrument 30. The measurement components of the instrument 30 may be disposed in a housing 111 shaped and sealed to be moved along the interior of a wellbore 32. The well logging instrument 30 may be, in a form hereof, an instrument of a type available under the trademark RT SCANNER, which is a trademark of Schlumberger Technology Corporation, Sugar Land, Tex.

The instrument housing 111 may contain at least one multi-axial electromagnetic transmitter 115, and two or more multi-axial electromagnetic receivers 116, 117 each disposed at different axial spacings from the transmitter 115. The transmitter 115, when activated, may emit a continuous wave electromagnetic field at one or more selected frequencies. Shielding (not shown) may be applied over the transmitter 115 and the receivers 116, 117 to protect the antenna coils which are deployed near the outer layer of the tool. The detectors 116, 117 may be multi-axis wire coils each coupled to a respective receiver circuit (not shown separately). Thus, detected electromagnetic energy may also be characterized at each of a plurality of distances from the transmitter 115.

The instrument housing 111 maybe coupled to an armored electrical cable 33 that may be extended into and retracted from the wellbore 32. The wellbore 32 may or may not include metal pipe or casing 16 therein. The cable 33 conducts electrical power to operate the instrument 30 from a surface 31 deployed recording system 70, and signals from the receivers 116, 117 may be processed by suitable circuitry 118 for transmission along the cable 33 to the recording system 70. The recording system 70 may include a computer as will be explained below for analysis of the detected signals as well as devices for recording the signals communicated along the cable 33 from the instrument 30 with respect to depth and/or time.

The well logging tool described above can also be used, for example, in logging-while-drilling ("LWD") equipment. A non-limiting example of a logging while drilling multi-axial logging instrument is available under the trademark PERISCOPE from Schlumberger Technology Corporation, Sugar Land, Tex. As shown, for example, in FIG. 1B, a platform and derrick 210 are positioned over a wellbore 212 that may be formed in the Earth by rotary drilling. A drill string 214 may be suspended within the borehole and may include a drill bit 216 attached thereto and rotated by a rotary table 218 (energized by means not shown) which engages a kelly 220 at the upper end of the drill string 214. The drill string 214 is typically suspended from a hook 222 attached to a traveling block (not shown). The kelly 220 may be connected to the hook 222 through a rotary swivel 224 which permits rotation of the drill string 214 relative to the hook 222. Alternatively, the drill string 214 and drill bit 216 may be rotated from the surface by a "top drive" type of drilling rig.

Drilling fluid or mud 226 is contained in a mud pit 228 adjacent to the derrick 210. A pump 230 pumps the drilling fluid 226 into the drill string 214 via a port in the swivel 224 to flow downward (as indicated by the flow arrow 232) through the center of the drill string 214. The drilling fluid exits the drill string via ports in the drill bit 216 and then circulates upward in the annular space between the outside of the drill string 214 and the wall of the wellbore 212, as indicated by the flow arrows 234. The drilling fluid 226 thereby lubricates the bit and carries formation cuttings to the surface of the earth. At the surface, the drilling fluid is returned to the mud pit 228 for recirculation. If desired, a directional drilling assembly (not shown) could also be employed.

A bottom hole assembly ("BHA") 236 may be mounted within the drill string 214, preferably near the drill bit 216. The BHA 236 may include subassemblies for making measurements, processing and storing information and for communicating with the Earth's surface. The bottom hole assembly is typically located within several drill collar lengths of the drill bit 216. In the illustrated BHA 236, a stabilizer collar section 238 is shown disposed immediately above the drill bit 216, followed in the upward direction by a drill collar section 240, another stabilizer collar section 242 and another drill collar section 244. This arrangement of drill collar sections and stabilizer collar sections is illustrative only, and other arrangements of components in any implementation of the BHA 236 may be used. The need for or desirability of the stabilizer collars will depend on drilling conditions.

Figure 1B:
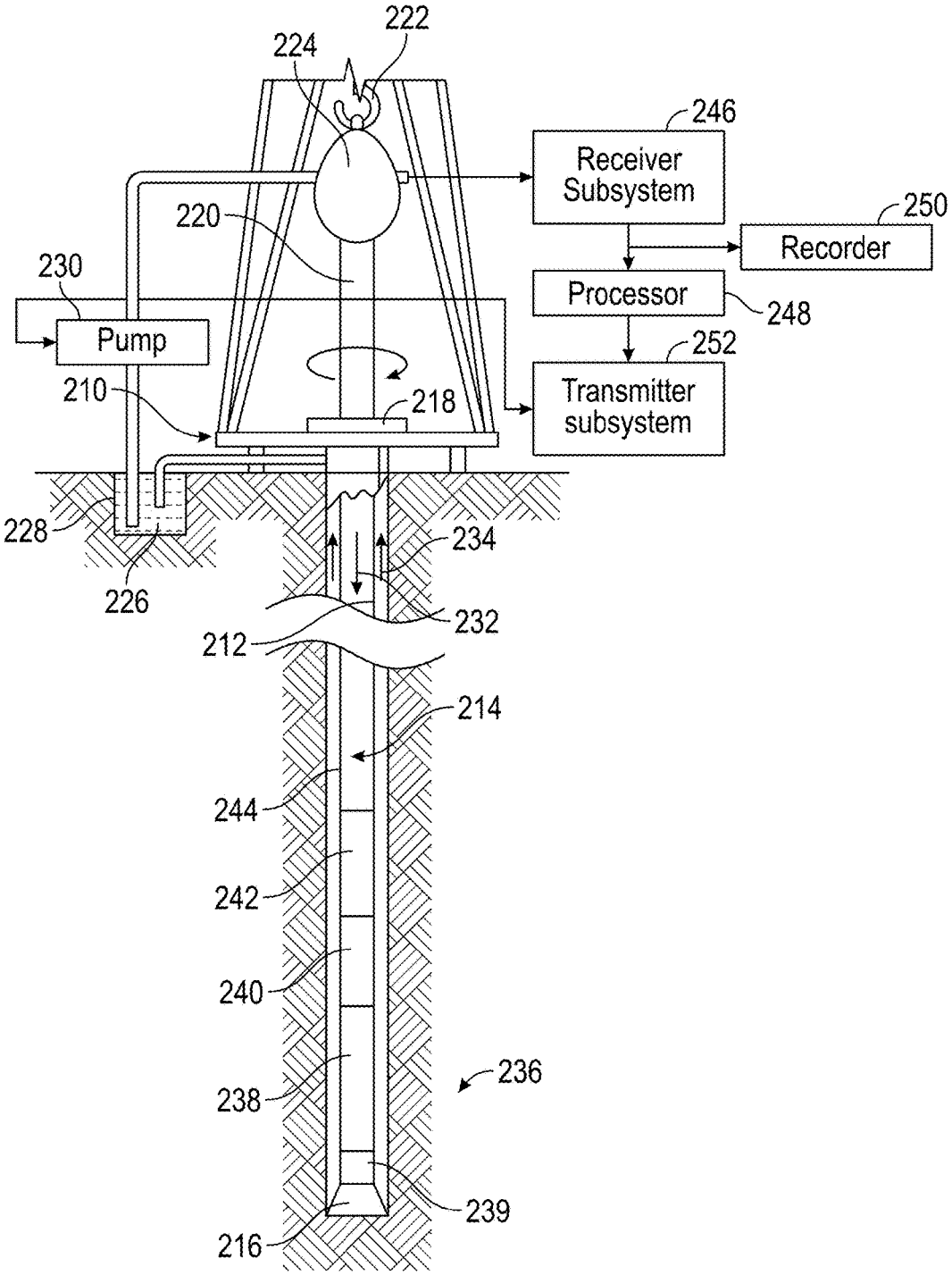
FIG. 1B shows an example well logging instrument system that may be used during wellbore drilling.

In the arrangement shown in FIG. 1B, the components of multi-axial induction well logging instrument may be located in the drill collar section 240 above the stabilizer collar 238. Such components could, if desired, be located closer to or farther from the drill bit 216, such as, for example, in either stabilizer collar section 238 or 242 or the drill collar section 244.

The BHA 236 may also include a telemetry subassembly (not shown) for data and control communication with the Earth's surface. Such telemetry subassembly may be of any suitable type, e.g., a mud pulse (pressure or acoustic) telemetry system, wired drill pipe, etc., which receives output signals from LWD measuring instruments in the BHA 236 (including the one or more radiation detectors) and transmits encoded signals representative of such outputs to the surface where the signals are detected, decoded in a receiver subsystem 246, and applied to a processor 248 and/or a recorder 250. The processor 248 may comprise, for example, a suitably programmed general or special purpose processor. A surface transmitter subsystem 252 may also be provided for establishing downward communication with the bottom hole assembly.

The BHA 236 may also include conventional acquisition and processing electronics (not shown) comprising a microprocessor system (with associated memory, clock and timing circuitry, and interface circuitry) capable of timing the operation of the accelerator and the data measuring sensors, storing data from the measuring sensors, processing the data and storing the results, and coupling any desired portion of the data to the telemetry components for transmission to the surface. The data may also be stored downhole and retrieved at the surface upon removal of the drill string. Power for the LWD instrumentation may be provided by battery or, as known in the art, by a turbine generator disposed in the BHA 236 and powered by the flow of drilling fluid. The LWD instrumentation may also include directional sensors (not shown separately) that make measurements of the geomagnetic orientation or geodetic orientation of the BHA 236 and the gravitational orientation of the BHA 236, both rotationally and axially.

The BHA 236 may also include a directional drilling device 239. The directional drilling device 239 enables a drilling unit (i.e., the equipment described above as part of the BHA) operator to adjust the trajectory of the well being drilled by rotating the drill bit 216 and lengthening the drill string 216. In some embodiments, the directional drilling device 239 may be used to cause the well to follow a trajectory or path along the "bedding plane" (the geologic layering) of a formation having fractures therein. As will be explained further below with reference to FIG. 34, such path may be adjusted during drilling such that the well path intersects such fractures approximately perpendicularly to the plane of such fractures. The directional drilling device 239 may be, in some embodiments, a "steerable drilling motor" or a "rotary steerable directional drilling system", both of which are well known in the art and enable well path direction changes without the need to remove the drill string 216 from the well.

While the description that follows is based on measurements made from a tool such as the RT SCANNER instrument, described with reference to FIG. 1A or the PERISCOPE instrument, described with reference to FIG. 1B in which each of the transmitter and receivers comprises mutually orthogonal induction coils with one coil being aligned with the instrument's longitudinal axis, it is to be understood that for purposes of defining the scope of the disclosure, any induction well logging instrument with multi-axial transmitter(s) and receiver(s) having magnetic dipole axes along other directions and in other than three magnetic dipole axis elements (e.g., coils) per transmitter or receiver may be used provided that for each such transmitter and receiver it is possible to resolve three mutually orthogonal components of the transmitted electromagnetic field and the received electromagnetic field and where such resolved components are susceptible to either or both mechanical (physically embodied) or mathematical rotation to any selected coordinate system, e.g., Cartesian or cylindrical.

Tensor induction measurements such as those explained above with reference to FIGS. 1A, 1B and 2 for well placement and reservoir characterization applications have first harmonic cross-dipole couplings with up-down sensitivity. In LWD the measurement processing assumes a 1D transversely isotropic formation. In such cases, the boundary orientation [see U.S. Pat. No. 6,798,208 B2 issued to Omeragic and Wu, P., Wang, H., Minerbo, G., Homan, D., Barber, T., and Frey, M., 2007, *Borehole effects and correction in OBM with dip and anisotropy for triaxial induction tools*, paper SPE 110623 presented at the SPE Annual Technical Conference and Exhibition, Anaheim, Calif., November 11-14.] obtained from individual couplings is consistent for all spacings and frequencies, and corresponds to the tool azimuth where the cross-dipole coupling (XZ or ZX) is maximal for a rotating (LWD) tool (FIG. 1B), or can be obtained from the ratio of two orthogonal cross-dipole couplings XZ and YZ (and ZX and ZY) for the wireline case (FIG. 1A).

Figure 2:
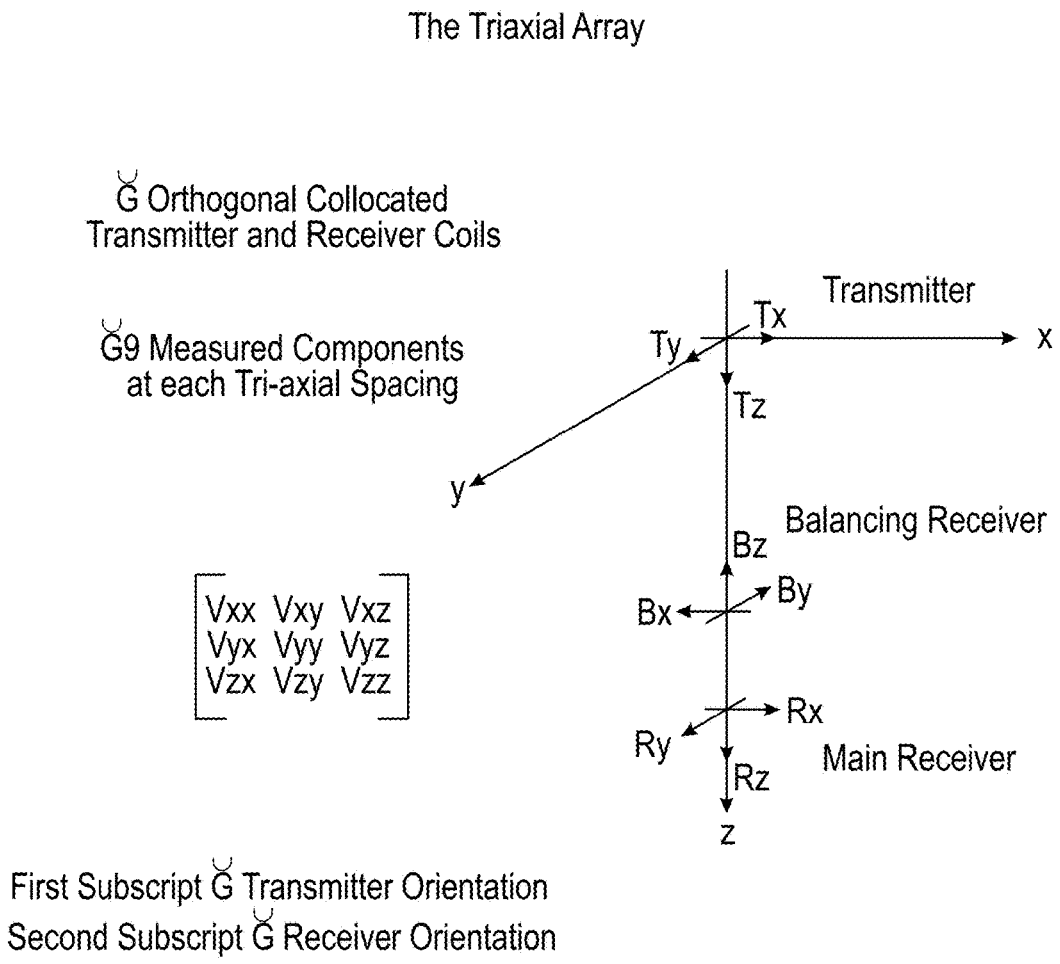
FIG. 2 (Prior Art)
FIG. 2 shows an illustration of a multiaxial (e.g., triaxial) induction array measurement devices (transmitter and receivers) at a given spacing between the transmitter and each receiver.

A tri-axial induction tool such as the RT SCANNER instrument described above measures nine-component transimpedance coupling voltages (Vm(i,j,k), i,j=x,y,z) which can be converted to apparent conductivity tensors (σm(i,j,k), i,j=x,y,z) at multiple longitudinal spacings from a transmitter, each represented by index k. The relation between Vm and σm is Vm=K•σm, where K is a constant k-factor matrix and • is symbol for matrix dot-product. FIG. 2 illustrates such a tri-axial measurement. These measurements may be obtained in the frequency domain by operating a multiaxial transmitter (in this case a mutually orthogonal three-axis transmitter Tx, Ty, Tz) with a continuous wave (CW) of a frequency selected to enhance the signal-to-noise ratio. However, measurements of the same information content could also be obtained and used from time domain signals through a Fourier decomposition process. This is a well know physics principle of frequency-time duality. Voltages are detected in corresponding receiver coil arrays which may include main receiver coils (Rx, Ry, Rz) and balancing or "bucking" coils series connected thereto (Bx, By, Bz). A plurality of receiver arrays may be disposed at different selected longitudinal distances from the transmitter. Formation properties, such as horizontal and vertical conductivities (σh, σv), relative dip angle (θ) and the dip azimuthal direction (Φ), as well as borehole/tool properties, such as mud conductivity (σmud), hole diameter (hd), tool eccentering distance (decc), tool eccentering azimuthal angle (ψ), all affect the conductivity tensors. It will be appreciated by those skilled in the art that the voltage measurement of interest is that which is exactly out of phase with the current amplitude in the transmitter, that is, one caused by induction of eddy currents in the formations (which are 90 degrees out of phase with the transmitter current) and subsequently induced in the receiver(s) by the eddy currents (which are 90 degrees out of phase with the eddy currents). Methods and apparatus for making such measurements and the principles thereof are well known in the art.

While the example shown in FIG. 2, and its embodiment in instruments such as the RT SCANNER instrument described above uses three, mutually orthogonal magnetic dipole antennas (in the form of wire coils) for each transmitter and receiver (both main and balancing or "bucking" receivers), such arrangement of not a limitation on the scope of the present disclosure. It should be clearly understood that any arrangement and number of dipole antennas may also be used if they have dipole moment directions and numbers of dipole moment directions such that the nine component tensor measurements described above may be resolved. Accordingly, use of the term "multiaxial" measurements is intended to include within its scope any arrangement of transmitters and receivers that is capable of obtaining measurements that can be directly used to obtain the 9 component tensor measurements or can be converted such as by trigonometric rotation into such tensor measurements.

1. Modeling of Fracture Response for a Triaxial Electromagnetic Induction Tool

Figure 3:
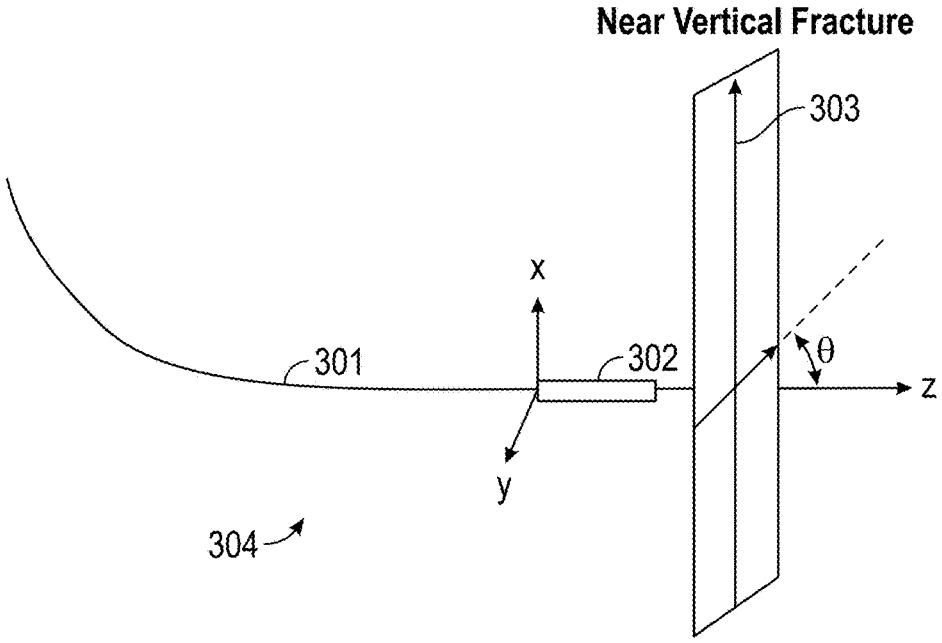
FIG. 3 shows a triaxial electromagnetic induction instrument moving through a horizontal wellbore that intersects a vertical fracture.

FIG. 3 is a schematic diagram of a vertical fracture 303 and a triaxial induction well logging instrument 302, e.g., the RT SCANNER instrument, moving through in a highly inclined or horizontal well 301 that intersects the fracture 303. The notations x, y, z refer to the three orthogonal directions of the magnetic dipole moment of the transmitter and receiver antennas in the well logging instrument. The z-direction is defined to be in line with the instrument and the wellbore axis. The x-direction is assumed to be pointed up or to the top-of-the-wellbore 301 direction. The y-direction follows the right-hand rule of the standard Cartesian coordinate system. The background formation 304 is assumed to be uniform and electrically anisotropic. Here, an electrically isotropic formation is considered as a subset of electrically anisotropic formations for which the horizontal and vertical resistivities have equal value (Rh=Rv). A fracture crosses the wellbore, and the fracture plane is assumed to be much larger in extent than the diameter of the well logging instrument. Although the RT SCANNER instrument uses three wire coils for each antenna (whether a transmitter or receiver), and the dipole moment directions of each of the three wire coils are mutually orthogonal, wherein one dipole moment direction is along the instrument's longitudinal axis, it should be clearly understood that different numbers of antennas, different forms of antenna, e.g., bipole electrodes, and different dipole moment directions for such antennas may be used in other instruments provided that it is possible to resolve the three mutually orthogonal transmitted electromagnetic wave components and to resolve the three mutually orthogonal detected voltage components from the signals transmitted and detected by such other configurations of antennas.

Figure 4:
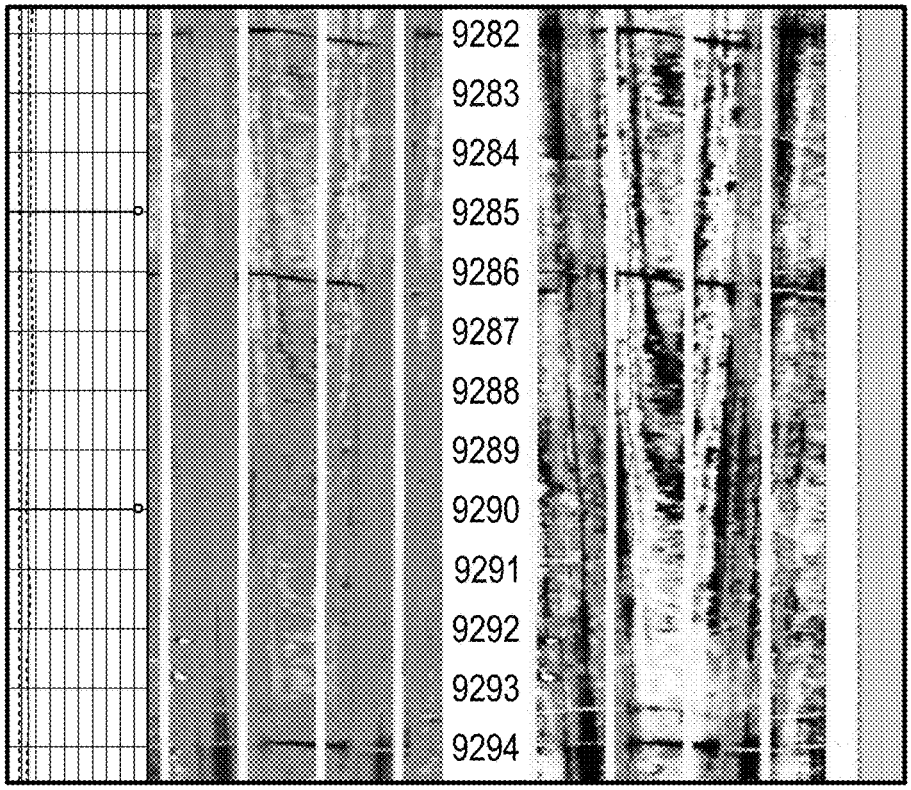
FIG. 4 shows an example of a horizontal well borehole image (FMI) showing vertical fractures nearly perpendicular to the well path. The unit of the depth scale in the middle is feet.

FIG. 4 shows an example of a wellbore wall image using a resistivity based wellbore wall contact-sensor imaging instrument (e.g., the formation microimager instrument—"FMI"). The figure shows several vertical fractures nearly perpendicular to the well path. These are the kind of fractures that methods according to the present disclosure are designed to detect and characterize.

Figure 5:
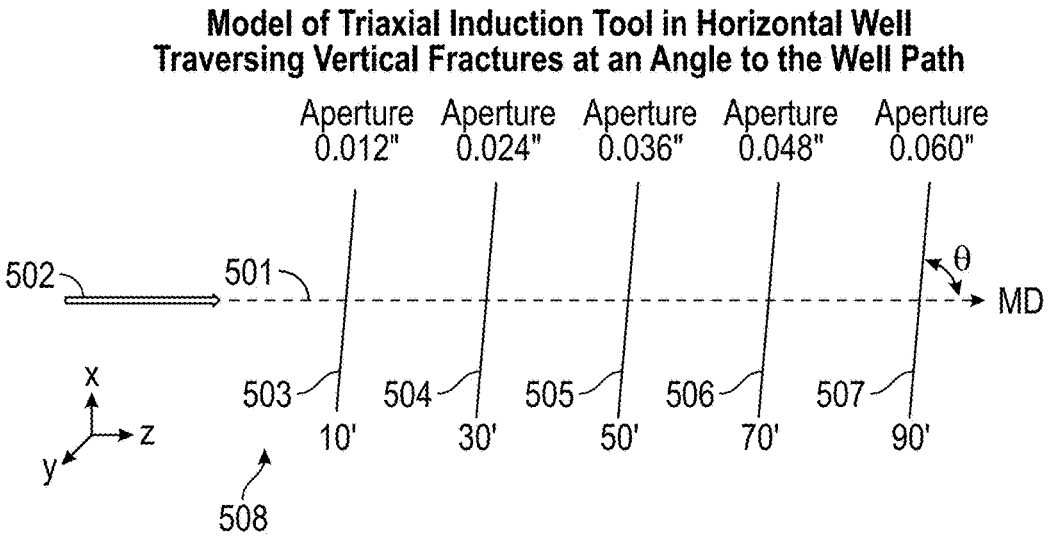
FIG. 5 shows a subsurface formation model for simulating instrument response through a series of large vertical fractures with increasing aperture. The model parameters represent typical gas shale condition of background resistivity of 20 ohm-m drilled with 0.2 ohm-m water based drilling fluid ("mud").

FIG. 5 shows a model of the triaxial induction well logging instrument 502 traversing horizontally through a wellbore 501 intersecting a series of vertical fractures 503-507 each at an angle θ with respect to the fracture plane. Five fractures 503-507 intersect the well path at locations 10, 30, 50, 70, and 90 ft. on the measured depth (MD) of the horizontal well. The apertures of the fractures 503-507 are 0.012", 0.024", 0.036", 0.048", and 0.060", as the MD of the fractures increase. The background formation 508 horizontal resistivity (Rh) and vertical resistivity (Rv) are 20 and 40 ohm-m, respectively. The fractures 503-507 are assumed to be open and filled with water based drilling fluid or "mud" (WBM) having resistivity of 0.2 ohm-m. The formation 508 modeled is similar in electrical properties to the Bakken formation in the Williston Basin, where the oil and gas production is related to the state of fractures of the formation. To achieve variation of the angle θ, in the modeling the assumed instrument orientation is changed while the fractures 503-507 and the background 508 anisotropy orientation remain constant. The angle θ may therefore be interpreted as relative angle between the well path (and consequently the instrument longitudinal axis) and the fractures.

Figure 6:
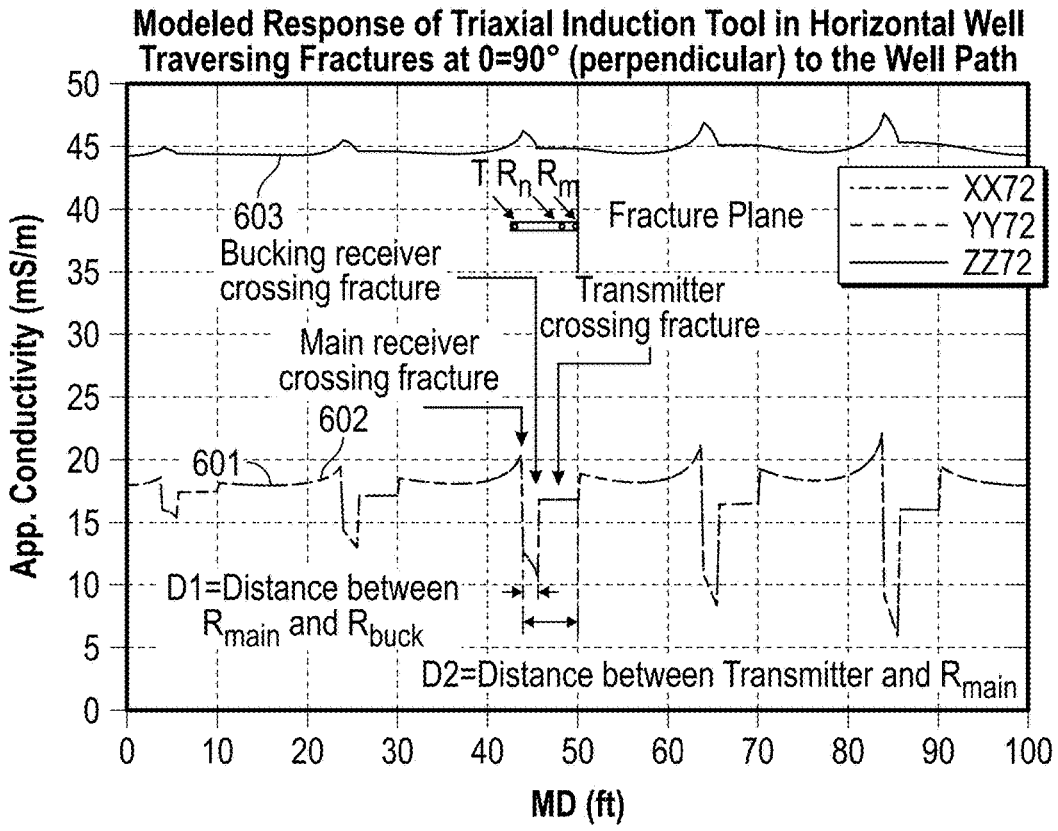
FIG. 6 shows simulated instrument response through a series of large vertical fractures with increasing aperture as depicted in FIG. 5. The angle between the fracture plane and the well trajectory is 90°, thus perpendicular to the well path.

FIG. 6 shows the XX 601, YY 602, and ZZ 603 components of the conductivity tensor from a triaxial induction well logging instrument through the fractures of FIG. 5 at an angle of 0=90°, i.e. perpendicular to the well path. The transmitter-to-main receiver distance is 72 inches and the transmitter-to-bucking receiver distance is 54 inches. The XX 601 and YY 602 responses are identical in this case. From this modeling result, it may be observed that the sharp drop of XX 601 and YY 602 responses as the main receiver crosses the fracture is a characteristic of the triaxial induction response signals in a horizontal well through vertical fractures. The magnitude of the drop is proportional to the fracture aperture. At the location of the sudden drop in XX 601 and YY 602, the ZZ 603 response component also shows a small peak.

Figure 7:
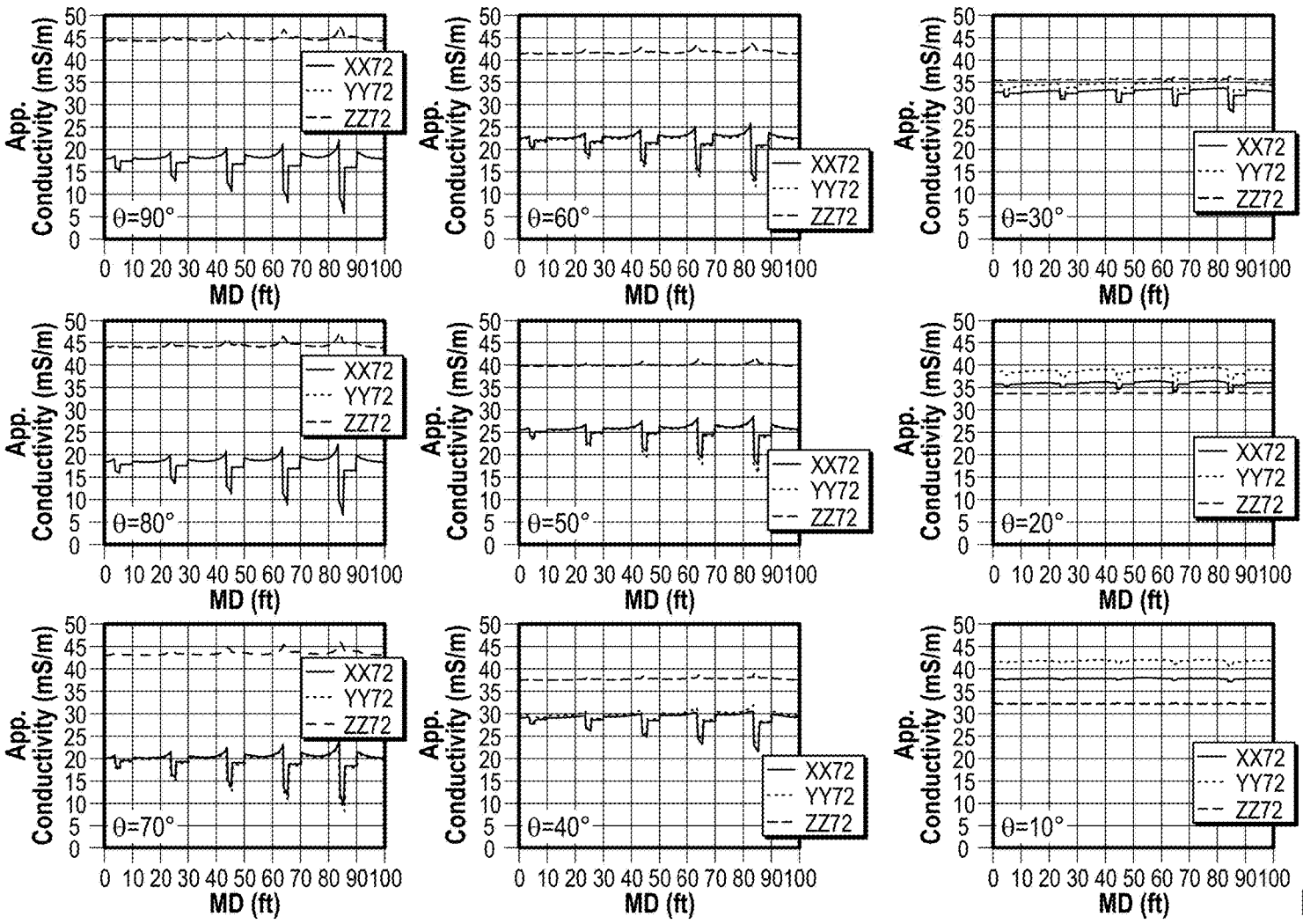
FIG. 7 shows modeled instrument response through a series of large vertical fractures with increasing aperture as depicted in FIG. 5. The subplots (1) through (9) show the model responses of the XX, YY, and ZZ response components for fractures intersecting the well path at θ=90°, 80°, 70°, . . . , 10°, respectively.

FIG. 7 in graphs 1 through 9 shows the XX, YY, and ZZ (red curve) responses through these same fractures for different value of angle of θ with respect to the well path. As the angle θ decreases, the mean levels of the XX and YY response increase and that for ZZ response decreases. These are the effect of the dipping anisotropy of the background formation. The characteristic of the fracture signals on the XX, YY and ZZ responses, namely the sudden drop in XX and YY responses with the ZZ response having a small peak, remain substantially the same notwithstanding the fracture angle with respect to the well path. One may observe a steady trend of decreasing in the magnitude of the sudden drop in XX and YY responses as the angle θ decreases. The rate of decrease is slower for θ>50° and faster for lower θ values. Compared with the effect of fracture aperture, which shows a linear increase as the aperture increase, the relationship of the induction responses to changes in θ is more non-linear.

Figure 8:
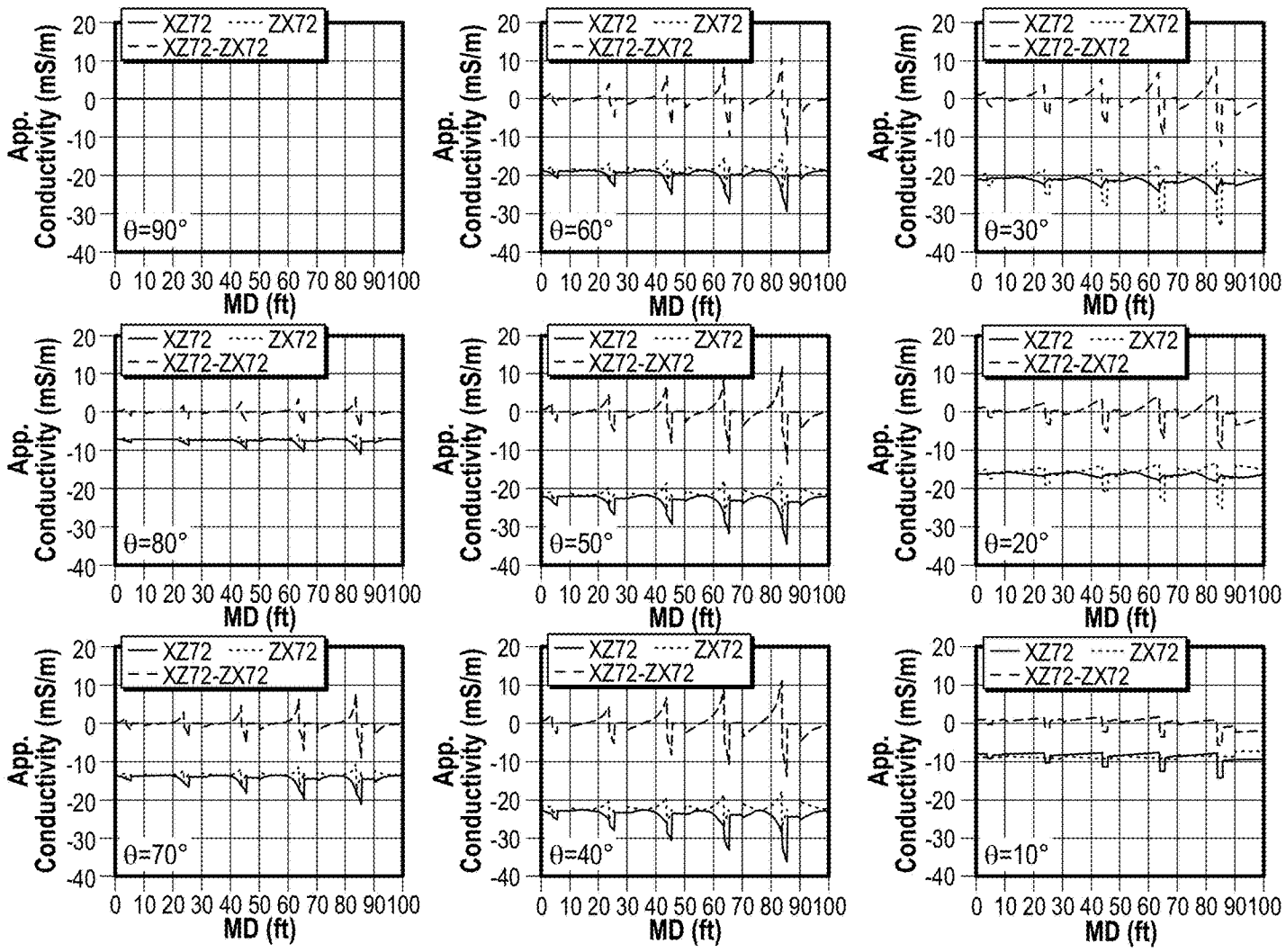
FIG. 8 shows modeled instrument response through a series of large vertical fractures with increasing aperture depicted in FIG. 5. The subplots (1) through (9) show the modeled responses of the XZ, ZX, and XZ−ZX signal components for fractures intersecting the well path at θ=90°, 80°, 70°, . . . , 10°, respectively.

FIG. 8 in graphs 1 through 9 shows the XZ, ZX, and XZ−ZX responses through these fractures for different value of the angle of 0 with respect to the well path. As the angle θ varies, the mean levels of the XZ, ZX and XZ+ZX change which is a response to the relative dip of the anisotropic background formation. XZ and ZX also exhibit a sharp change as the receivers and transmitter pass through the fractures. The variation of XZ and ZX may be in opposition directions. The XZ−ZX difference response, however, is known to free from dipping anisotropy effect. Therefore, the mean value of the XZ−ZX stays near zero regardless of the θ variation. The XZ−ZX difference response also exhibits a sharp drop as the main receiver passes through a fracture. The magnitude of the drop may depend in sensitivity to the fracture aperture and also the θ variation. The dependency to fracture aperture appears to be linear for all θ angles. Notice that at θ=0°, XZ and ZX have zero response. The dependency of θ variation appears to be more complex—the magnitude of the sharp drop increases toward a maximum as the angle θ decreases from 90° toward 45°. As the angle θ continues to decrease further toward 0°, the magnitude of the drop decreases.

The modeling results in FIGS. 7 and 8 show that the triaxial induction measurements may have good sensitivity to fracture location, aperture and angle θ, and that the triaxial induction measurements have a unique characteristic signature as the receiver crosses the fracture locations. An inversion technique according to the present disclosure will be described below to take advantage of this unique fracture signature and invert for fracture location, aperture and fracture strike (angle θ is the relative strike).

2. Modeling of Fracture Response for a Triaxial Electromagnetic Propagation Tool There is another type of multiaxial electromagnetic well logging instrument called an electromagnetic propagation tool. Such tools are known in the art in particular, but not exclusively, for logging while drilling ("LWD") applications, because the type of measurement made is more readily obtained when the antennas used to transmit and detect electromagnetic fields are disposed on an electrically conductive drilling tool such as a drill collar. Electromagnetic propagation tools generally measure attenuation and phase shift signals from a transmitter to between two receivers. By using two transmitters, one on each side of a receiver pair, one can derive compensated measurements which are substantially free of gain and phase errors associated with all the transmitter and receiver channels. The response of the propagation tool in a highly inclined or horizontal well to fractures will be described further herein.

Figure 9:
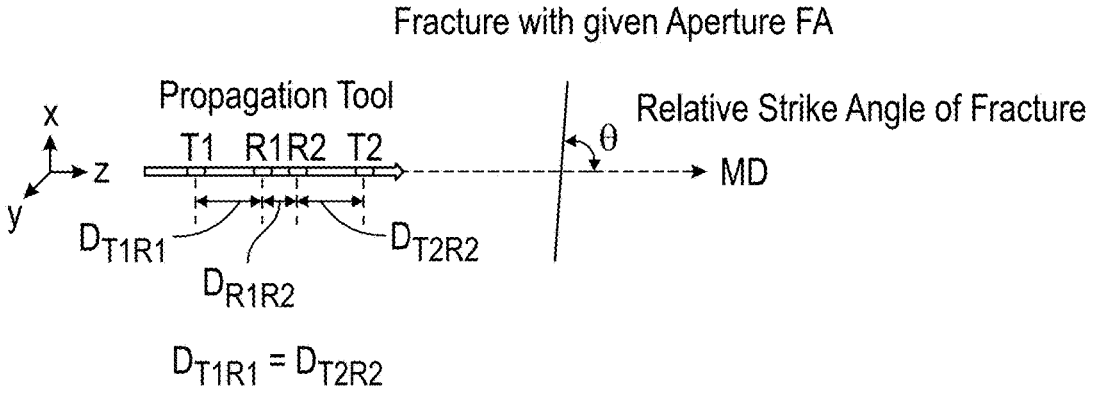
FIG. 9 shows a model of formations used to simulate response of a triaxial propagation tool moving horizontally through a large vertical fracture with a relative strike angle θ.

FIG. 9 shows a model of such a propagation tool traversing horizontally through a large open vertical fracture with an aperture, FA, at an angle θ with respect to the fracture plane. The background formation properties and mud resistivity are the same as those described with respect FIG. 5. The modeled instrument has two triaxial transmitters (T1 and T2) located on either side of a triaxial receiver pair (R1 and R2). The transmitters and receivers have three co-located, mutually orthogonal antenna coils, although other forms, numbers of and dipole moment directions of antennas may be used provided that the magnetic dipole moments of such antennas enable resolution of electromagnetic signal components along the stated three mutually orthogonal directions. The distance between R1 and R2 is represented by $D_{R1R2}$. The distance between T1 and R1 is represented by $D_{T1R1}$ and the distance between T2 and R2 is represented by $D_{T2R2}$. The example instrument is symmetric with respect to the spacing between the transmitters and receivers so $D_{T1R1}=D_{T2R2}$.

Let the transimpedance coupling voltage tensors for actuating T1 and receiving at R1 and R2 at any given measurement depth be represented by the expression:

$V_{T1R1}(i,j), V_{T1R2}(i,j), i,j=1,2,3$ for $x,y,z$ direction coupling, respectively.

Similarly, $V_{T2R1}$ (i,j), $V_{T2R2}$ (i,j), are the transimpedance coupling voltage tensors for actuating T2 and receiving at R1 and R2, respectively.

A compensated propagation measurement may be represented by the expression:

$$CV(i,j)=(V_{T1R1}(i,j)./V_{T1R2}(i,j)).*(V_{T2R2}(i,j)./V_{T2R1}(i,j))$$

Here the ./ and .* are symbols for dot divide and dot multiply for the tensors.

The attenuation and phase shift measurements of the example well logging instrument over the region spanned by the receiver pair (R1-R2) are given by the expressions:

$$Att(i,j)=20*\log 10(ABS(CV(i,j)))$$

$$PS(i,j)=A\ \mathrm{TAN}\ 2(\mathrm{Imag}(CV(i,j)), \mathrm{Real}(CV(i,j)))$$

Where ABS( ) represents the absolute value of the complex number within the parentheses ( ) ATAN2 represents the 4 quadrant inverse tangent function, and Imag( ) and Real( ) represent the imaginary and real and parts, respectively, of a complex number within the parentheses ( ).

Att(i,j) and PS(i,j) thus constructed would cancel out substantially all imbalance of transmitter and receiver gains to obtain accurate attenuation and phase shift measurements. To demonstrate the characteristic signature of a fracture on the propagation measurements and the sensitivity of the measurement to fracture aperture and relative strike angle θ, five cases of fracture aperture (FA) from 0.001 feet, with 0.001 foot increments to a maximum FA of 0.005 feet are modeled. For each case of FA, nine cases of relative strike angle θ from 10° with 10° increment to 90° are modeled.

Figure 10:
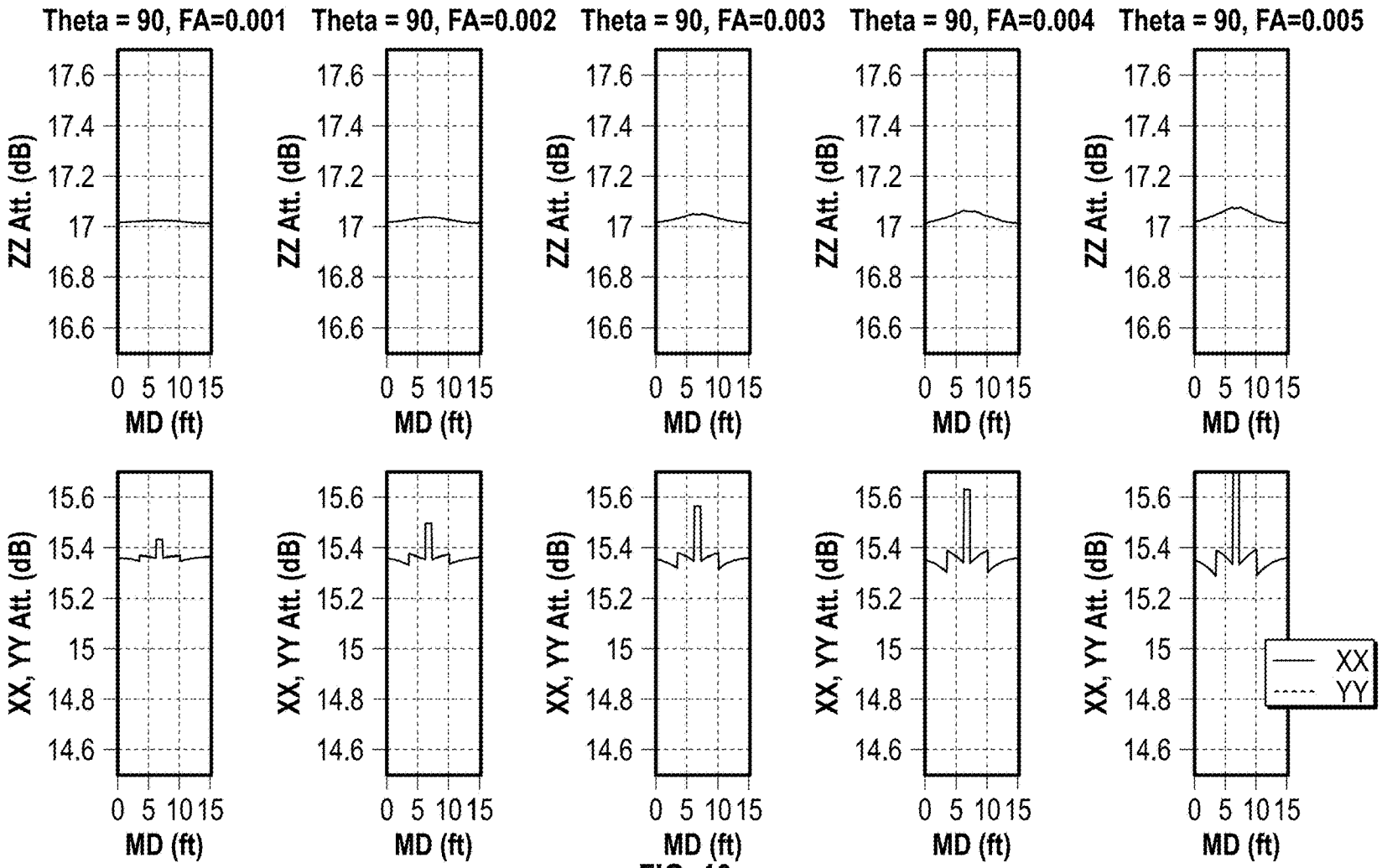
FIG. 10 shows XX, YY, and ZZ Att response of a triaxial propagation tool moving horizontally through a large vertical fracture with relative strike angle of 90°.
Figure 11:
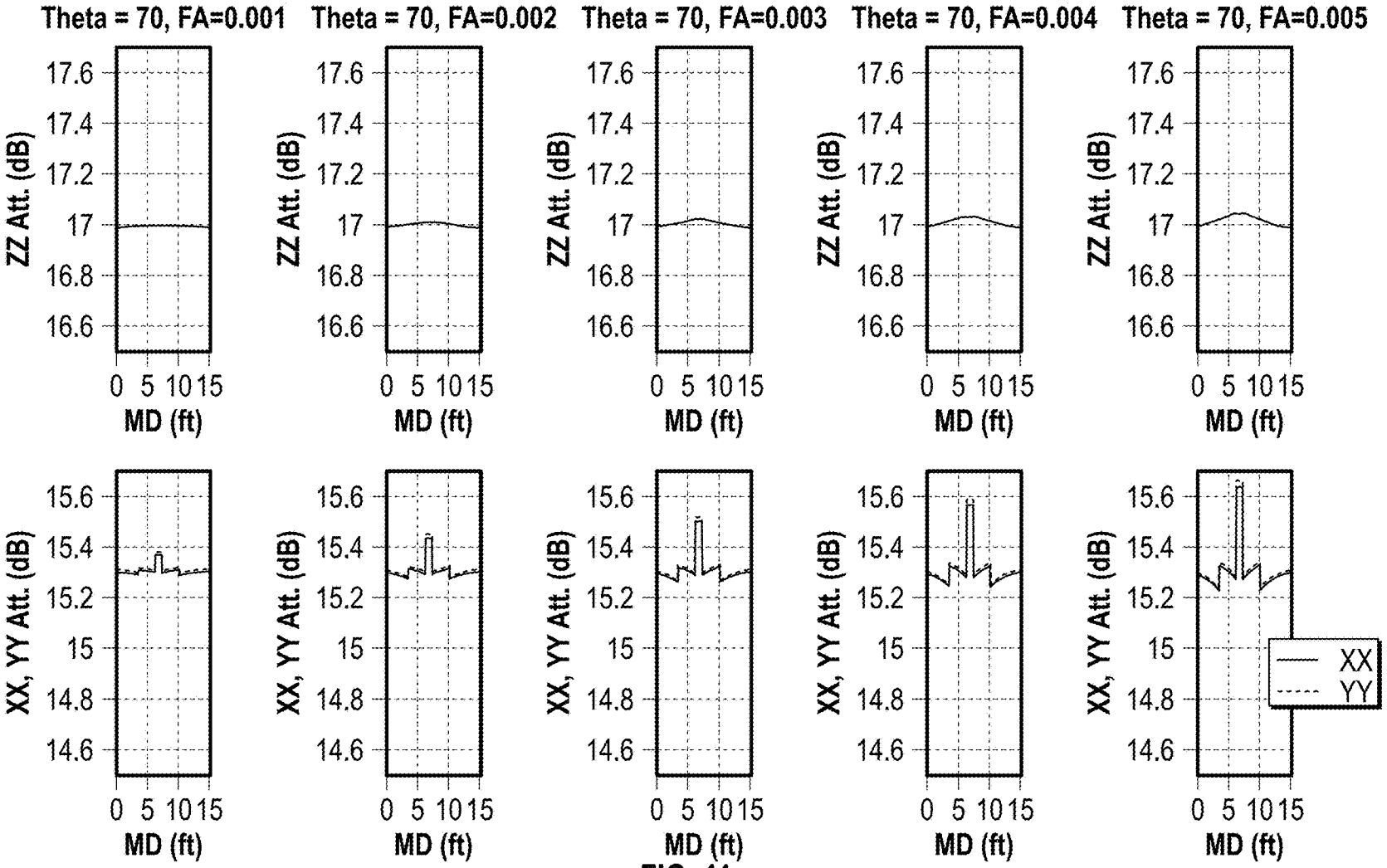
FIG. 11 shows XX, YY, and ZZ Att response of triaxial propagation tool moving horizontally through a large vertical fracture with relative strike angle of 70°.
Figure 12:
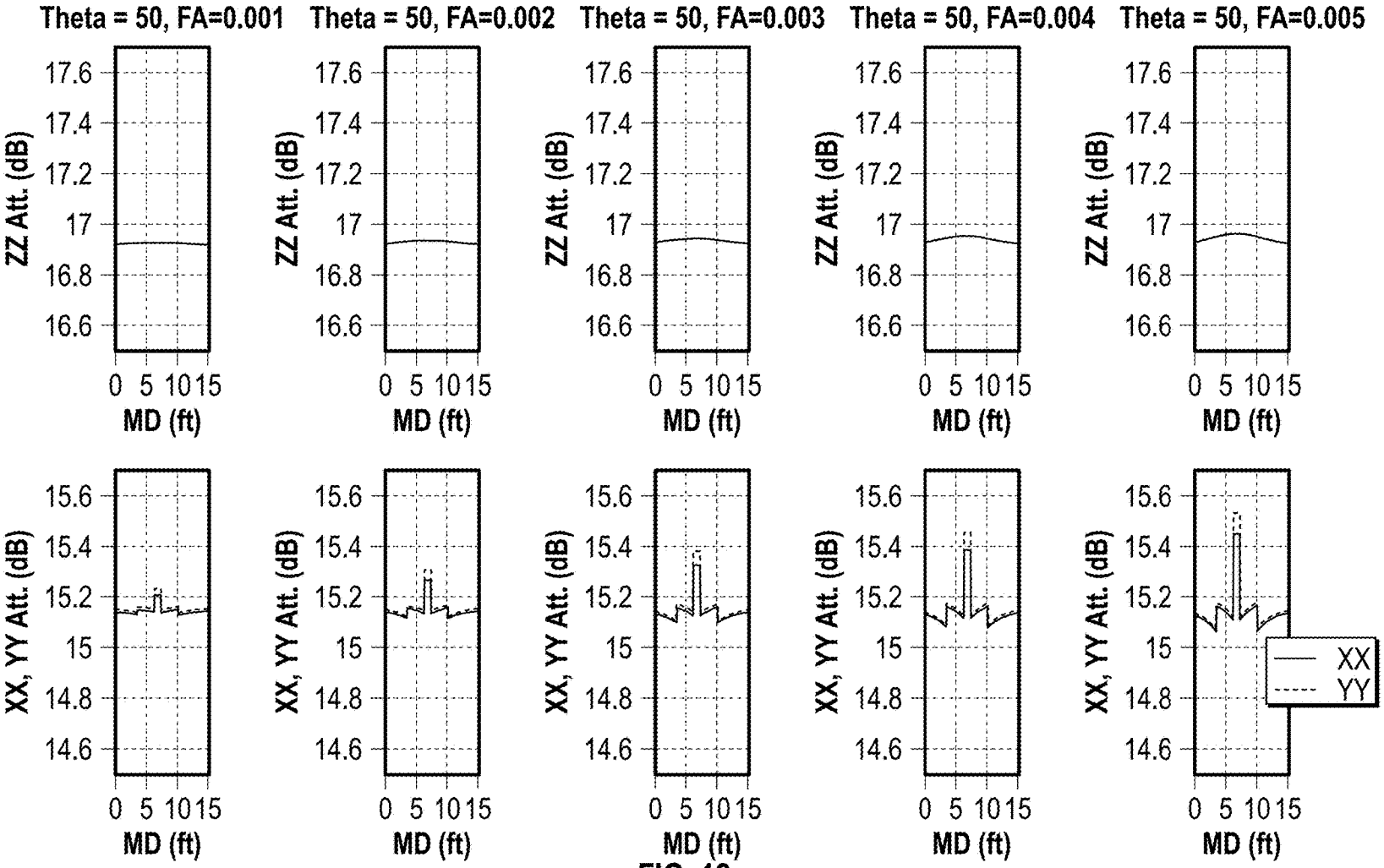
FIG. 12 shows XX, YY, and ZZ Att response of triaxial propagation tool moving horizontally through a large vertical fracture with a relative strike angle of 50°.
Figure 13:
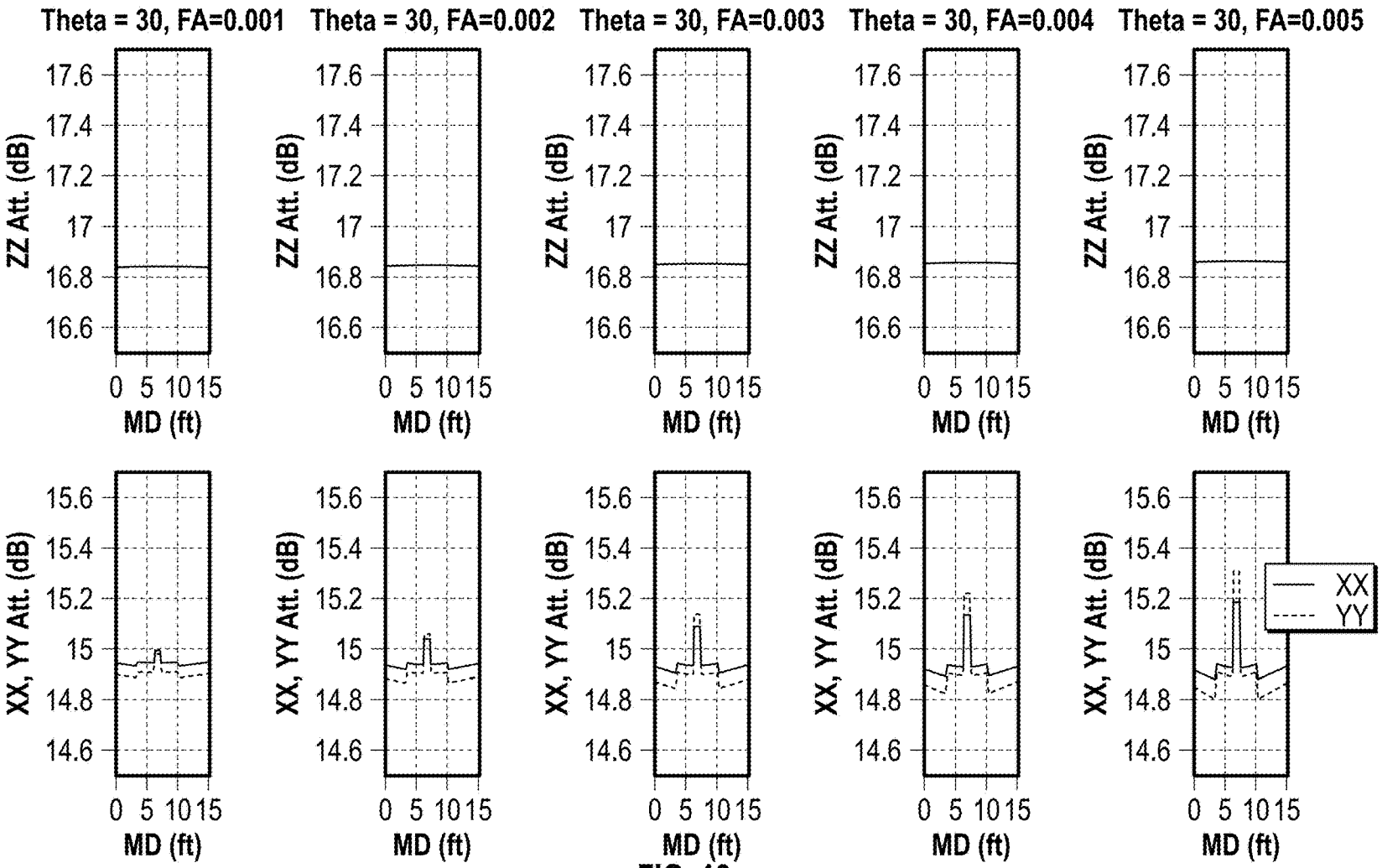
FIG. 13 shows XX, YY, and ZZ Att response of triaxial propagation tool moving horizontally through a large vertical fracture with a relative strike angle of 30°.
Figure 14:
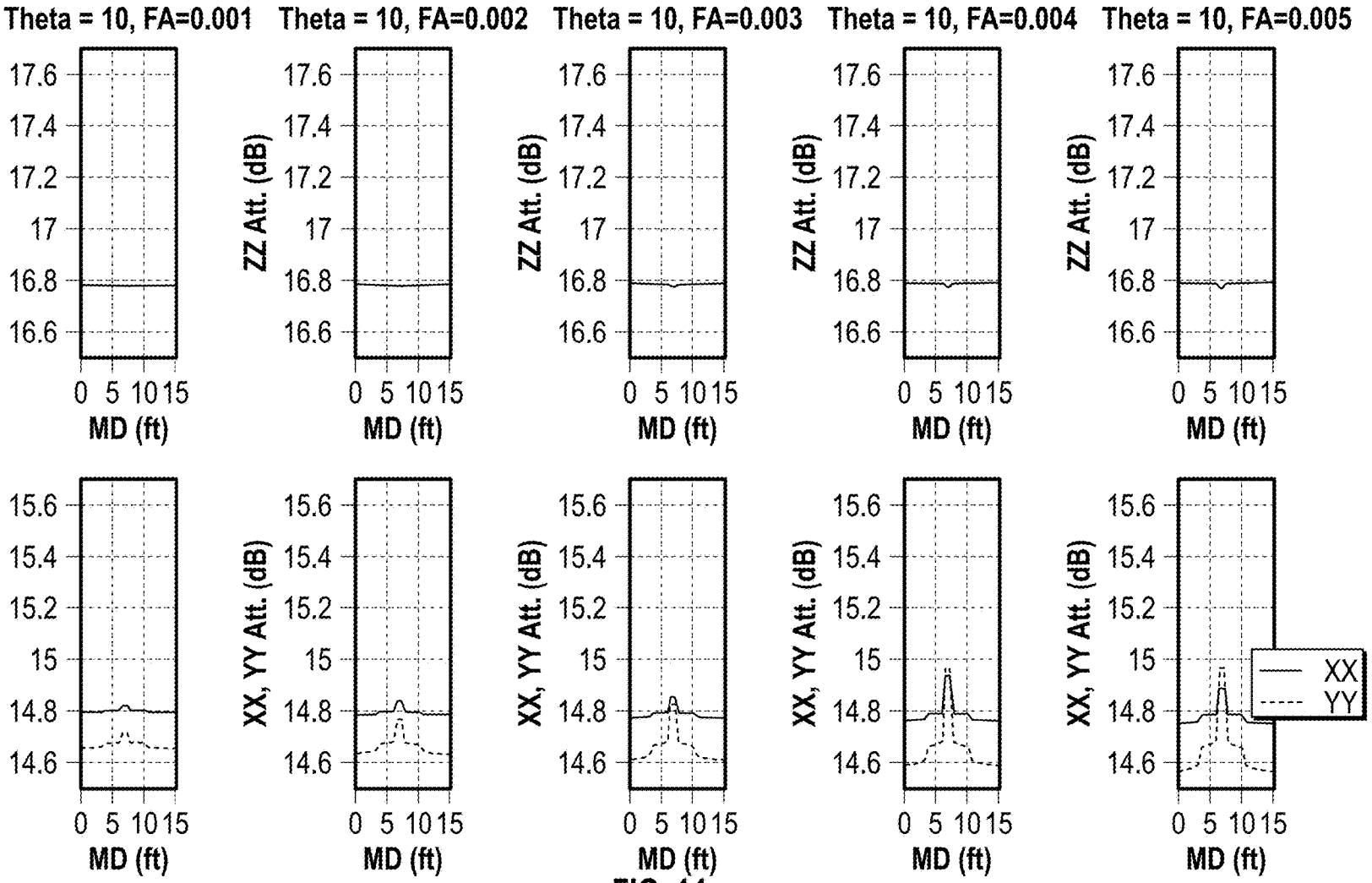
FIG. 14 shows XX, YY, and ZZ Att response of triaxial propagation tool moving horizontally through a large vertical fracture with a relative strike angle of 10°.
Figure 15:
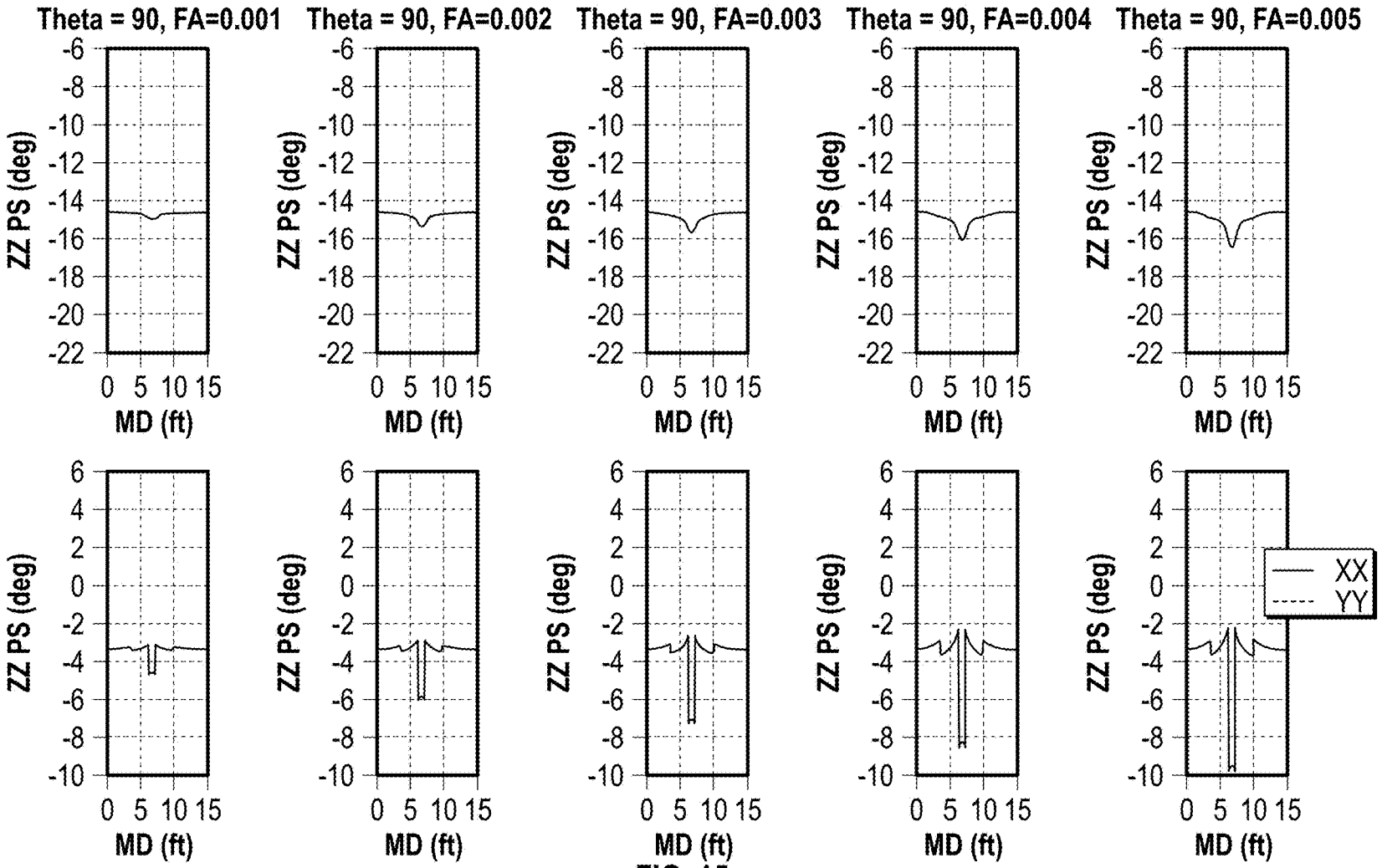
FIGS. 15 through 18 and 18A show XX, YY and ZZ phase shift response in a triaxial propagation tool as in FIGS. 10 through 14, respectively.
Figure 16:
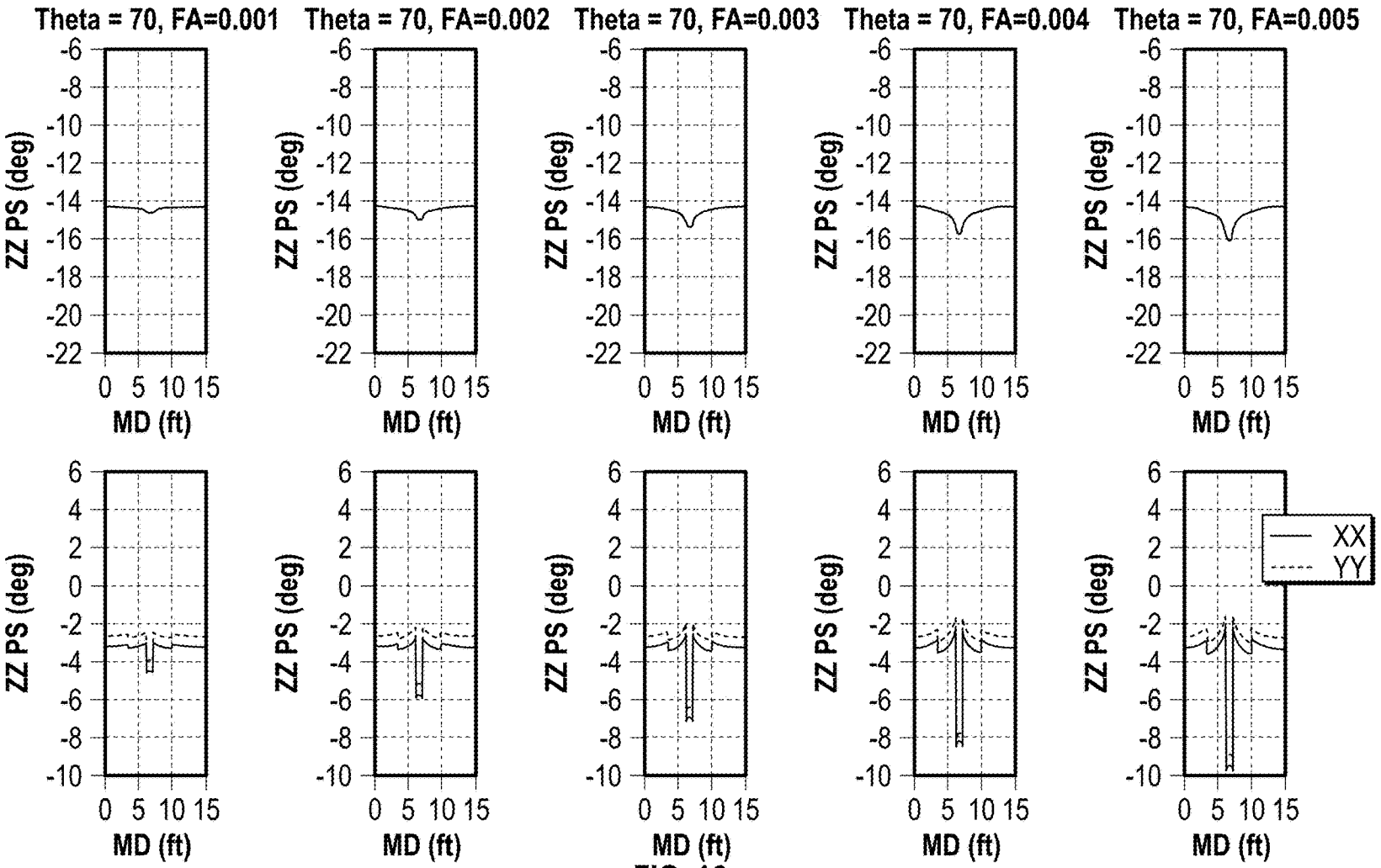
Figure 17:
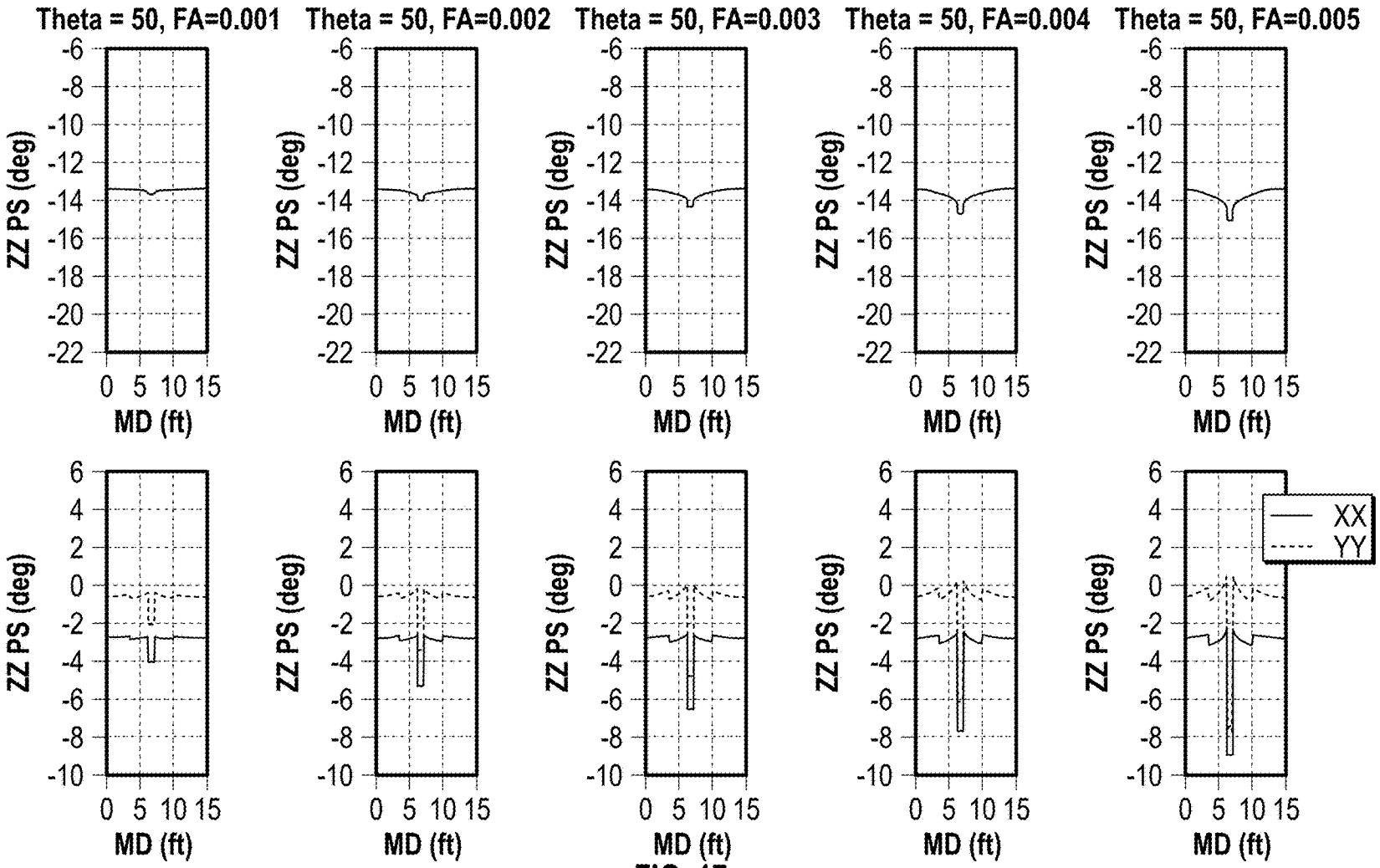
Figure 18:
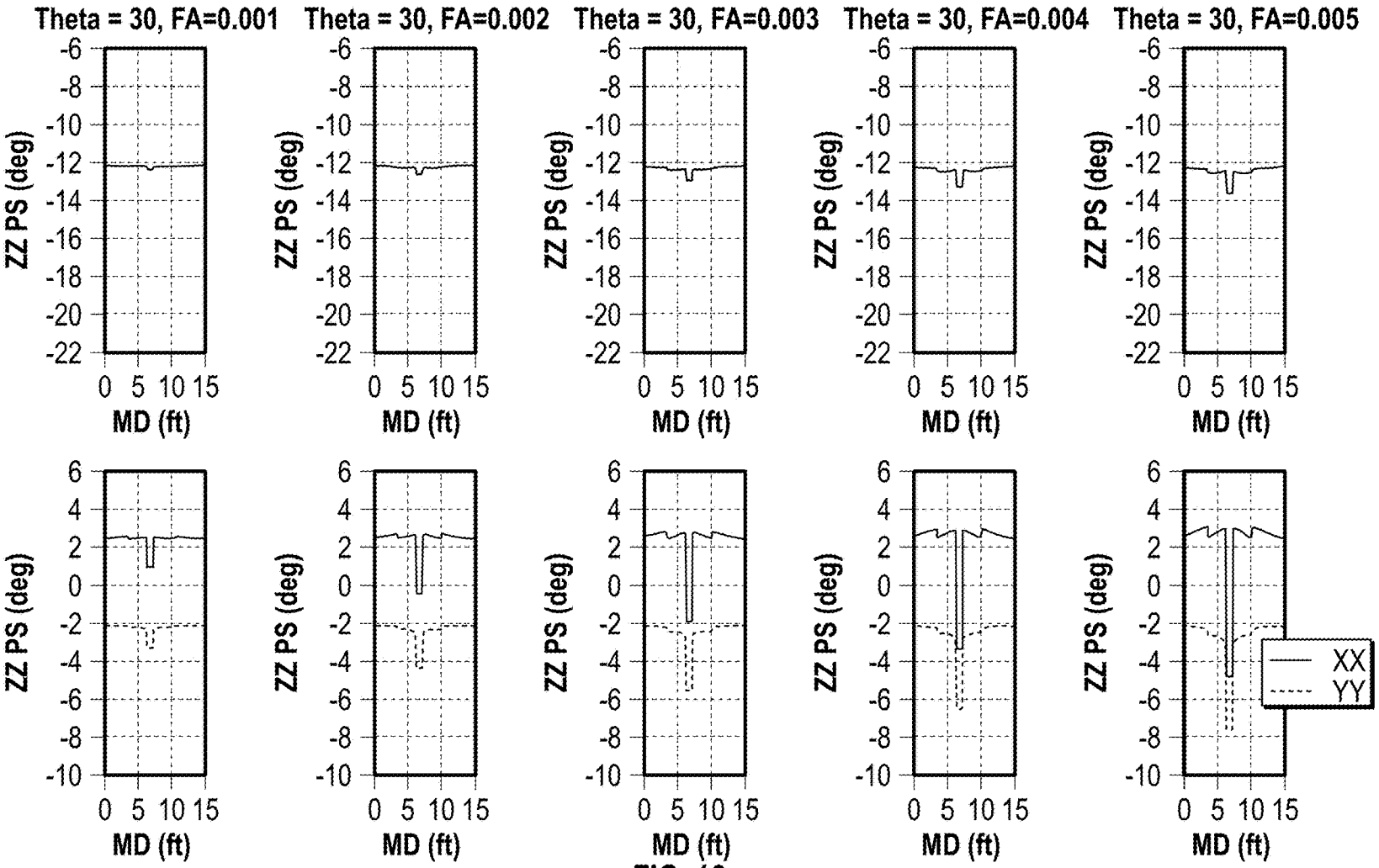
Figure 18A:
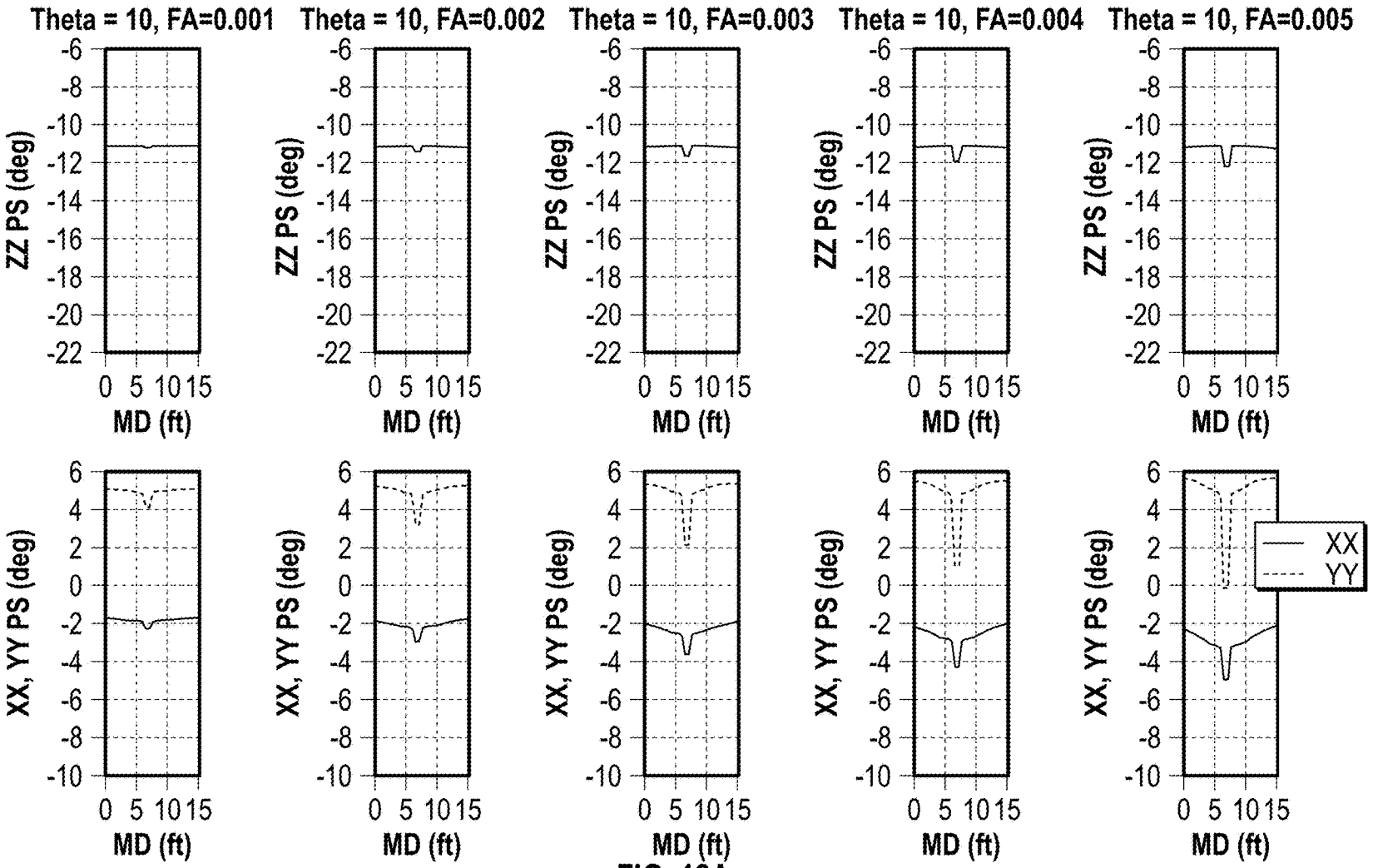
Figure 19:
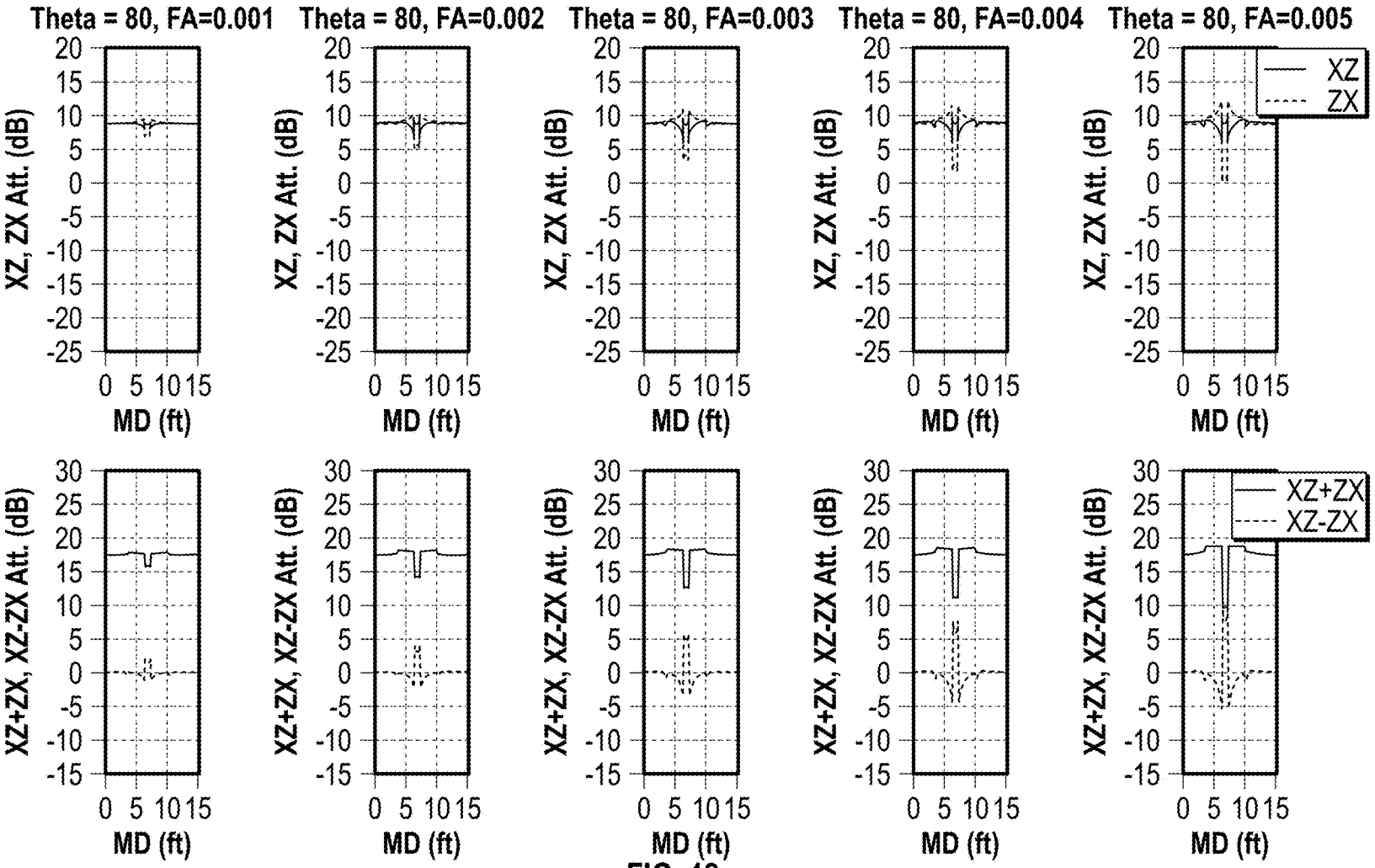
FIGS. 19 through 22 show the XZ, ZX, ZX+XZ and ZX−XZ attenuation response components of the triaxial propagation tool moving through a horizontal wellbore at successively smaller strike angles.
Figure 20:
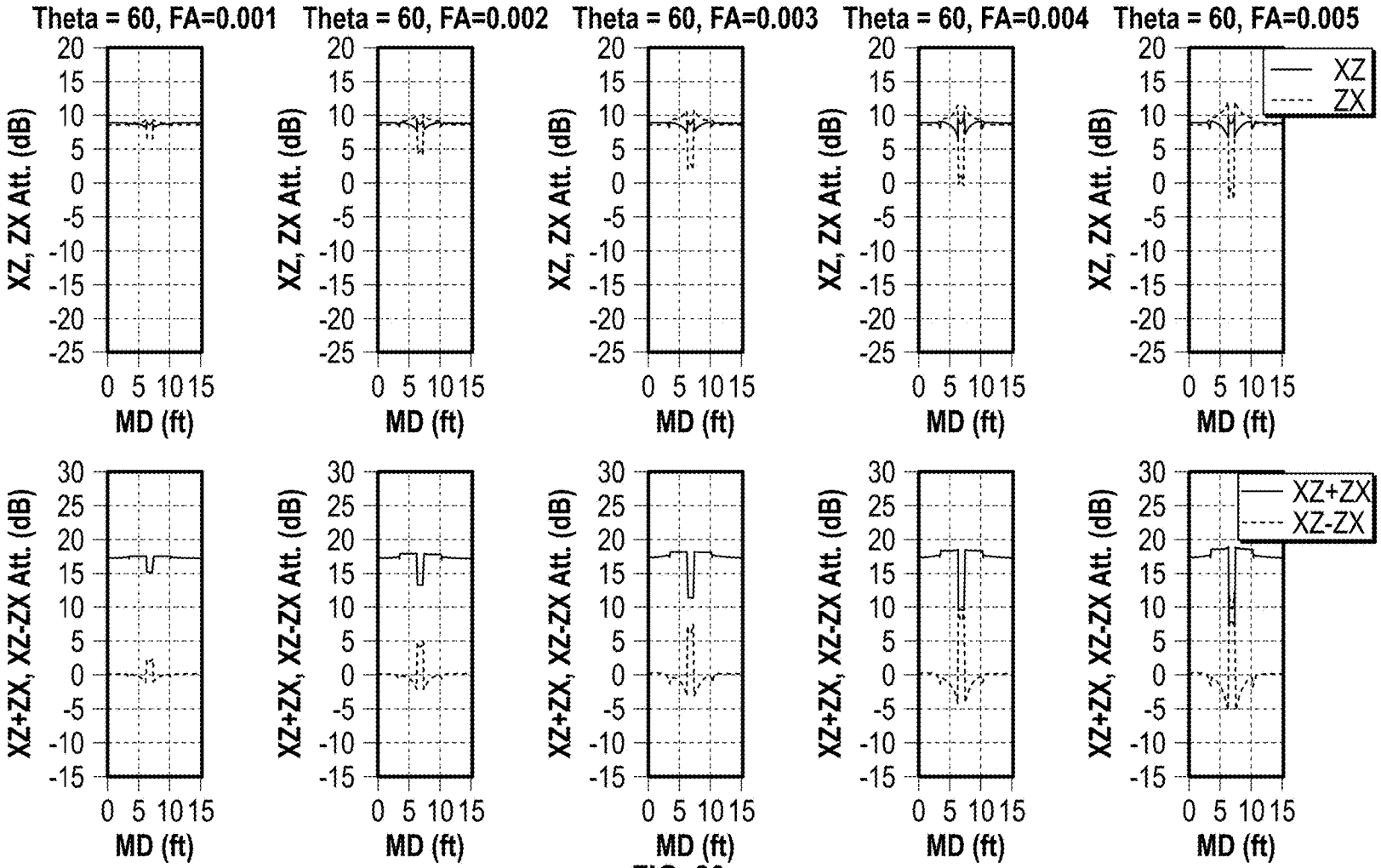
Figure 21:
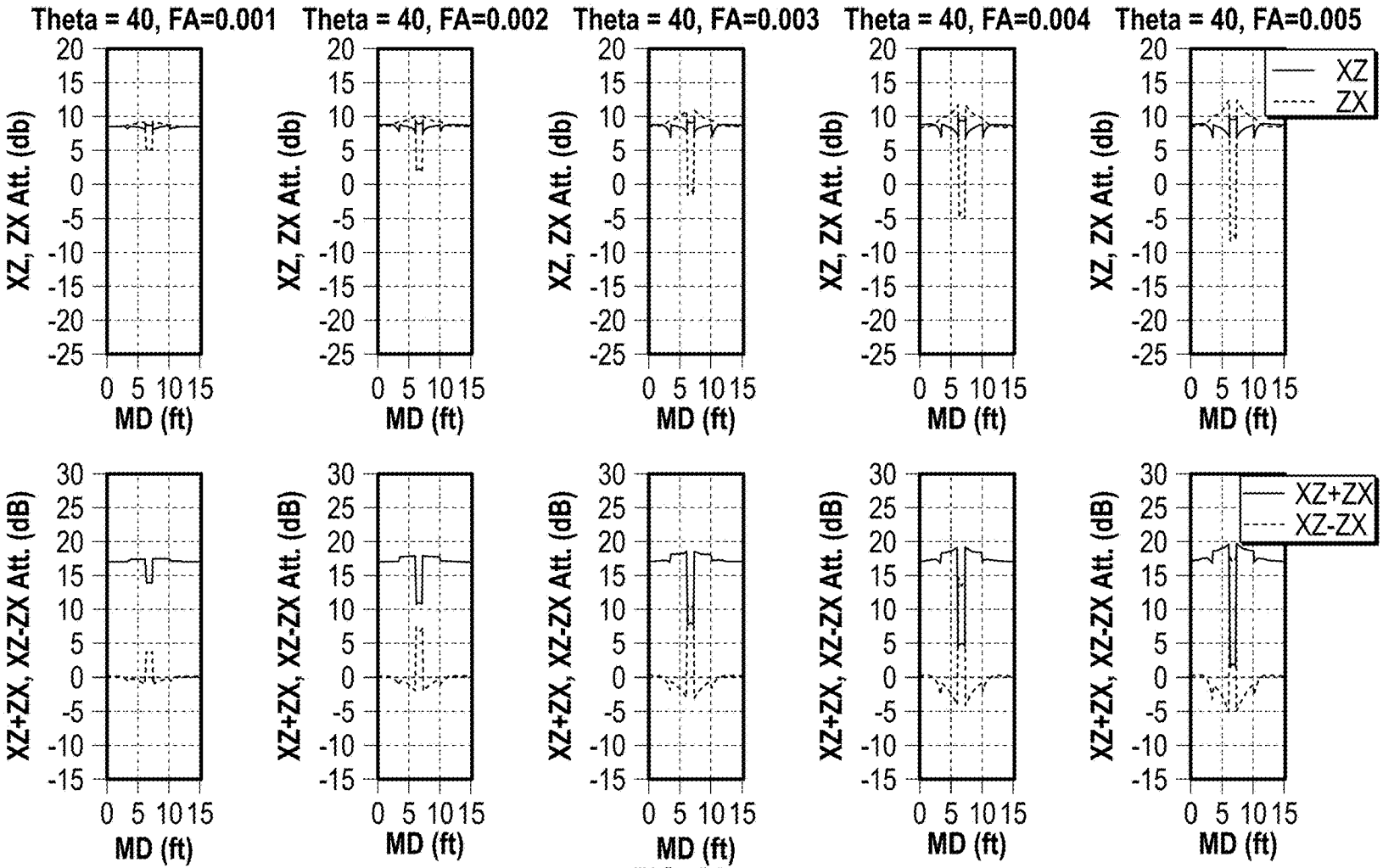
Figure 22:
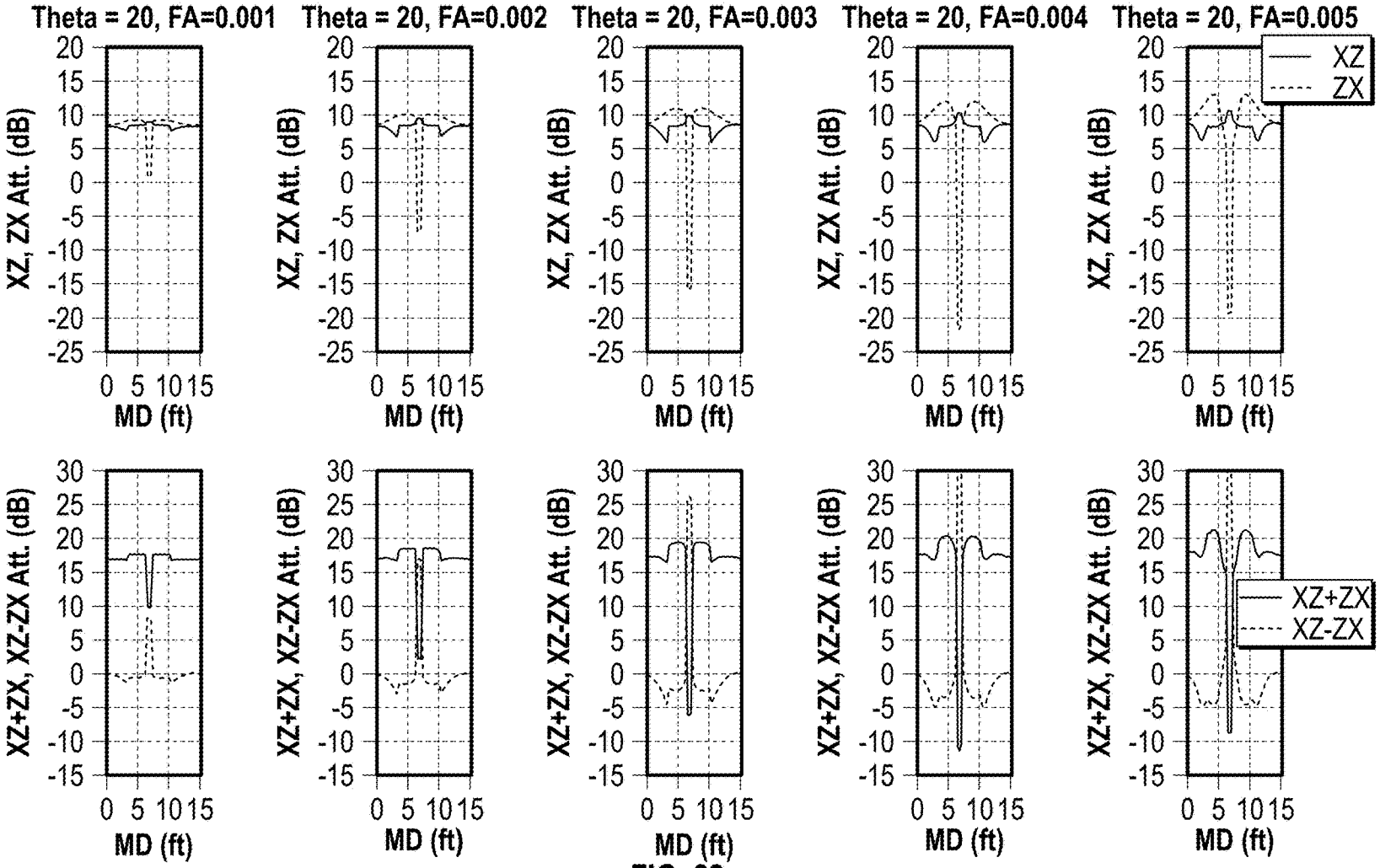
Figure 23:
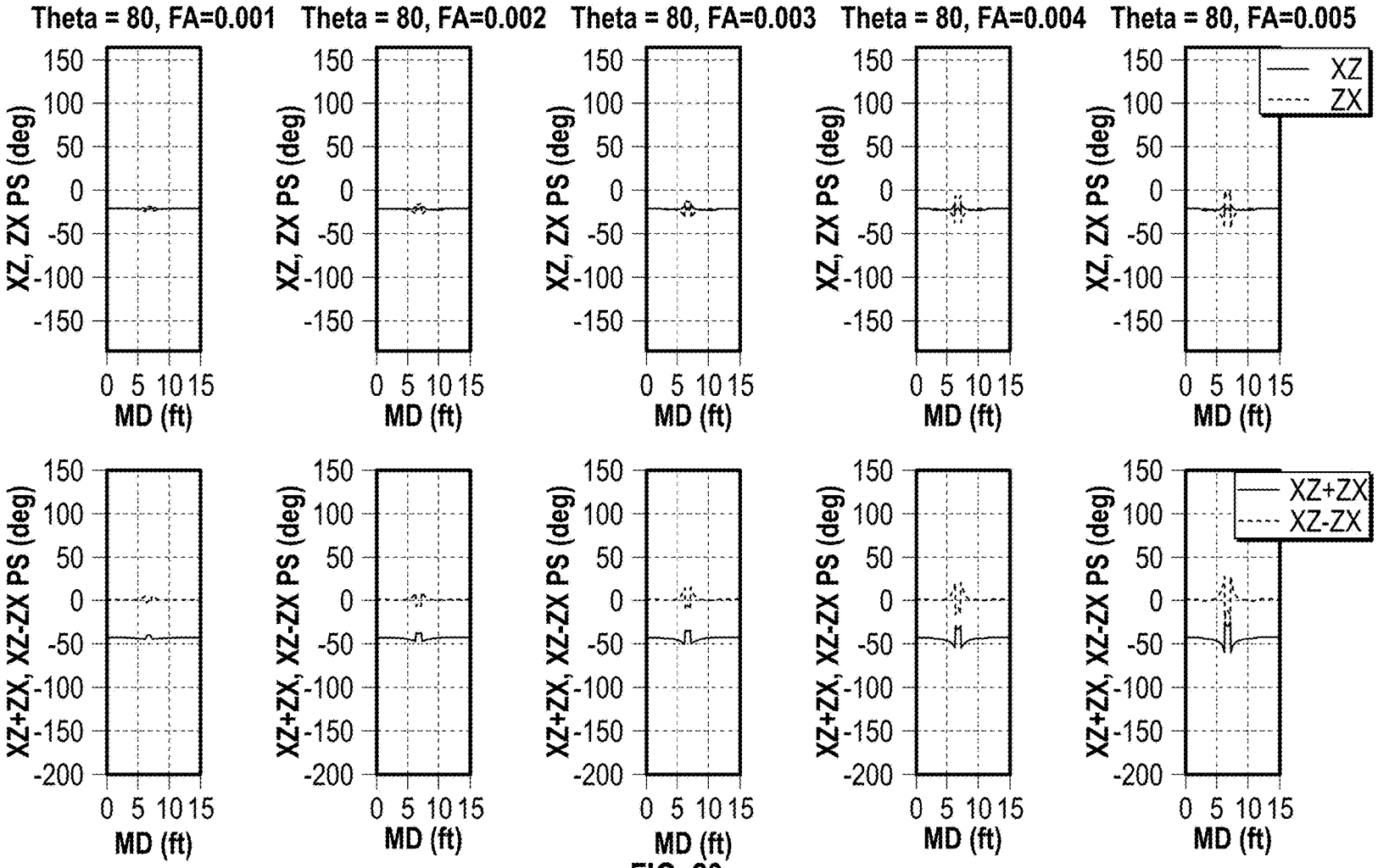
FIGS. 23 through 26 show the corresponding phase shift response to the conditions described with reference to FIGS. 19 through 22.
Figure 24:
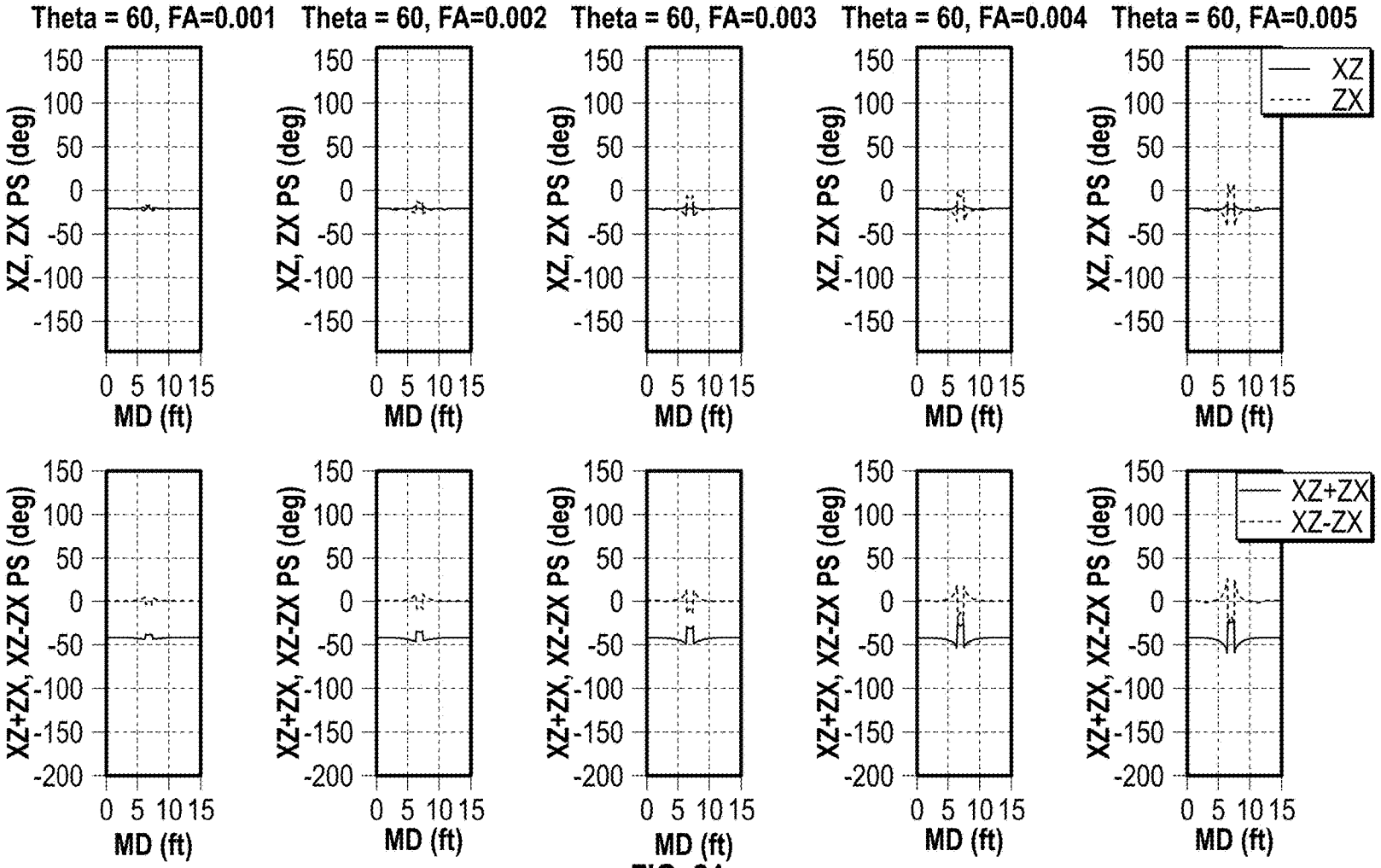
Figure 25:
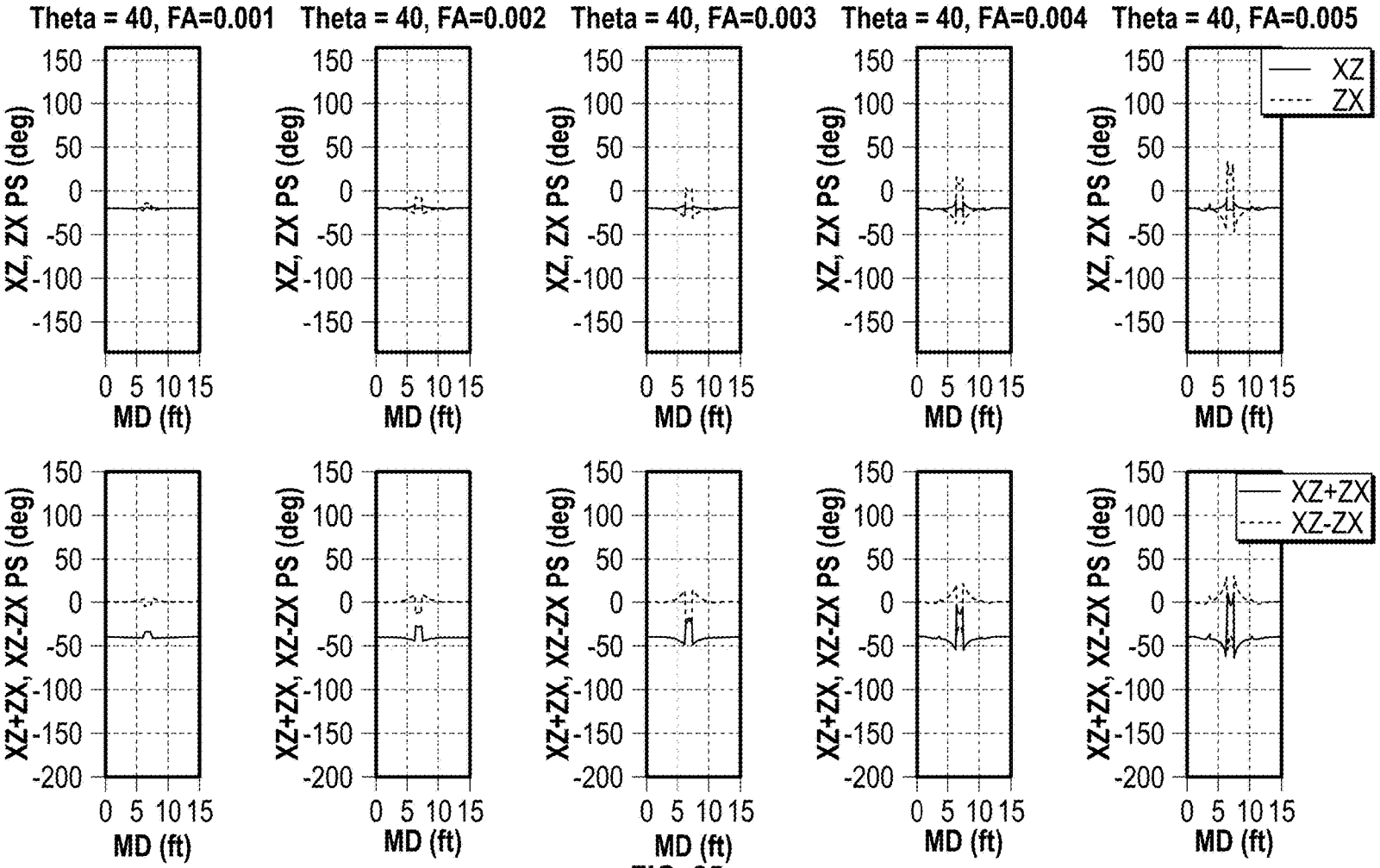
Figure 26:
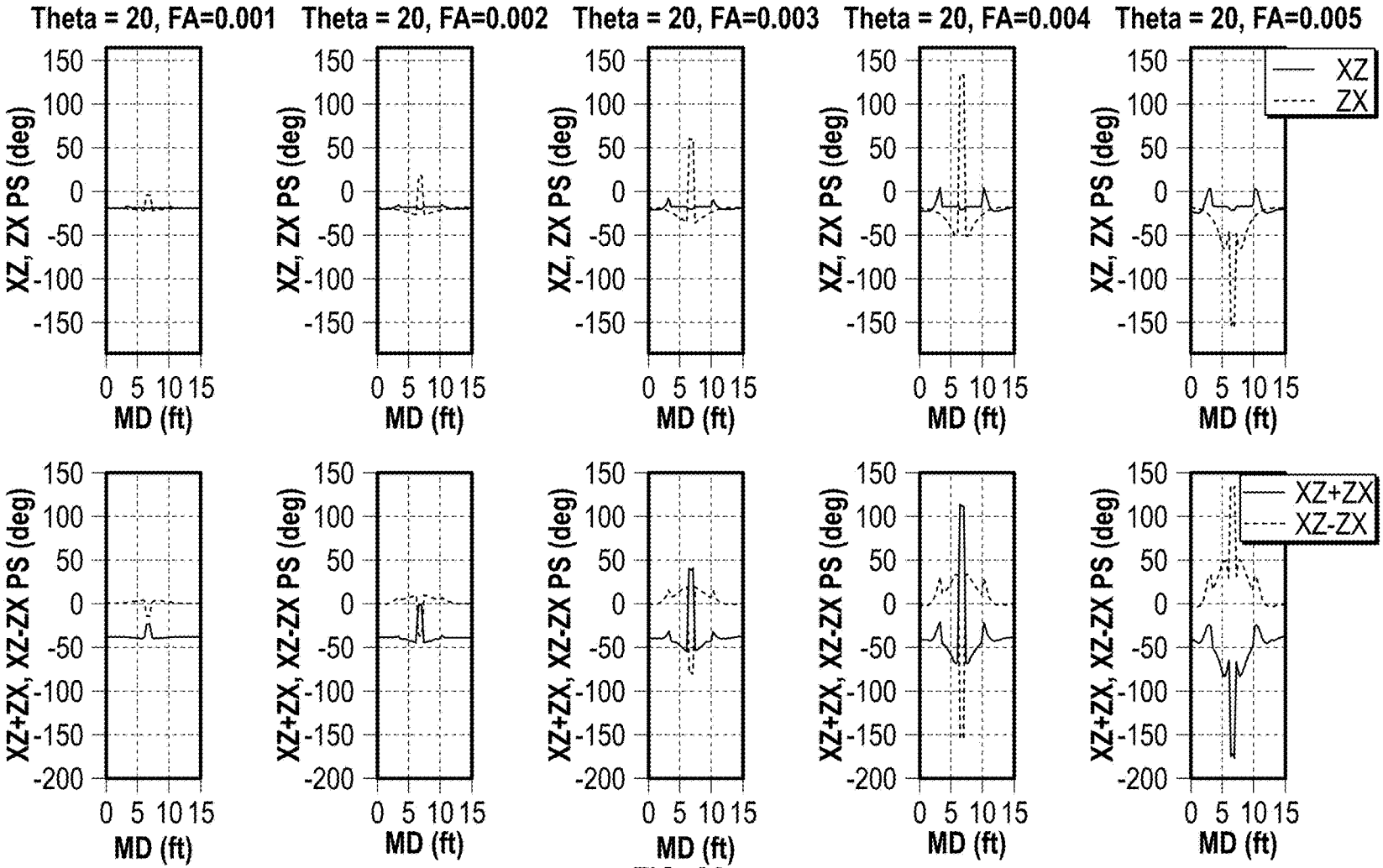

FIG. 10 shows the Att responses for the XX, YY, and ZZ components to a facture located at 10 ft. and a relative strike angle θ=90°. The ZZ component is plotted on the top and XX and YY are on the bottom. There are five rows of subplots from left to right corresponding to fracture aperture (FA) value of 0.001 foot with 0.001 foot increment to 0.005 feet, respectively. As the instrument travels from left to right (see FIG. 9), the XX and YY responses show an initial small step jump as the right most transmitter (T2) crosses the fracture. The XX and YY responses have a large step jump 33 inches later as the R2 receiver crosses the fracture. For the next 12 inches, the responses remain essentially constant and then exhibit a sharp drop as the R1 receiver crosses the fracture. Finally, another 33 inches later, as the T1 transmitter crosses the fracture, the XX and YY responses exhibit a small step drop back to the background level. The largest sharp step change as the R2 crossing the fracture are bracketed by the two red dots on the plot, one at 7 feet and the other at 7.5 feet. The ZZ response, on the other hand, appears to show only a small peak when the fracture crosses either of the receivers R1 and R2. These characteristic signatures of XX, YY, and ZZ responding to fracture are similar to the corresponding responses for the electromagnetic induction measurements described above. The amplitude of the peak in the XX and YY responses is proportional to the fracture aperture. The fracture location may be detected as the peak location of the first derivative with respect to depth (axial position) of the XX and YY responses. Similar fracture signatures may be observed in FIGS. 11 through 14, which correspond to the relative strike angles θ=70°, 50°, 30°, and 10°, respectively.

FIGS. 15 through 18A are the phase shift (PS) responses for the XX, YY, and ZZ components to a facture located at 10 feet distance with a relative strike angle θ=90°, 70°, 50°, 30°, and 10°, respectively. The ZZ component is plotted on the top and the XX and YY components are plotted on the bottom. There are 5 rows of subplots from left to right corresponding to fracture aperture (FA) value of 0.001 foot with 0.001 foot increment to 0.005 feet, respectively. The characteristic signatures of the PS responses are very similar to those for Att except the XX and YY PS response has a downward spike as the R1 and R2 receivers pass the fracture, while the ZZ PS shows a gentle downward peak at the fracture.

At a relative strike angle θ=90°, the XZ and ZX cross-components and all other off-diagonal components exhibit zero response to the fracture.

FIGS. 19 through 22 show the Att responses for XZ, ZX, (on top) and XZ+ZX, XZ−ZX (on bottom) components to a facture located at 10 ft. distance with relative strike angles θ=80°, 60°, 40°, and 20°, respectively. As the relative strike angle θ varies, the mean levels of the XZ, ZX Att responses change, which is a response to the relative dip of the anisotropic background formation. The XZ−ZX response, however, appears to be free from dipping anisotropy effect. Therefore, the mean value of the XZ−ZX response stays at approximately zero regardless of the variation in the relative strike angle θ. Although XZ, ZX, XZ+ZX and XZ−ZX all show a shape step change as the receivers pass through the fracture, the XZ−ZX response provides a clear indication of the fracture because it is not affected by the dipping anisotropy effect of the background formation. The characteristic signatures of the Att responses for XZ, ZX, and XZ+ZX, XZ−ZX signal components are very similar to those observed in the XX and YY response except as to the following two points: First, at θ=90° the XZ and ZX components have zero response while the XX and YY have responses that continue through the entire possible strike angle θ range. Second, the amplitude of the step change due to the fracture is larger in XZ and ZX than XX and YY.

FIGS. 23 through 26 show the PS responses for XZ, ZX, (on top) and XZ+ZX, XZ−ZX (on bottom) components to a facture located at 10 ft. with the relative strike angle θ=80°, 60°, 40°, and 20°, respectively. The characteristic signatures of the PS responses to fracture are very similar to those for Att responses discussed above. Note that in FIG. 26 for θ=20° the right most plot for FA=0.005 ft, the PS as the R1 and R2 is passing the fracture is so large that it is wrapped on the graph. That is why compared with the smaller FA cases, the large step change is in opposite direction.

Figure 27:
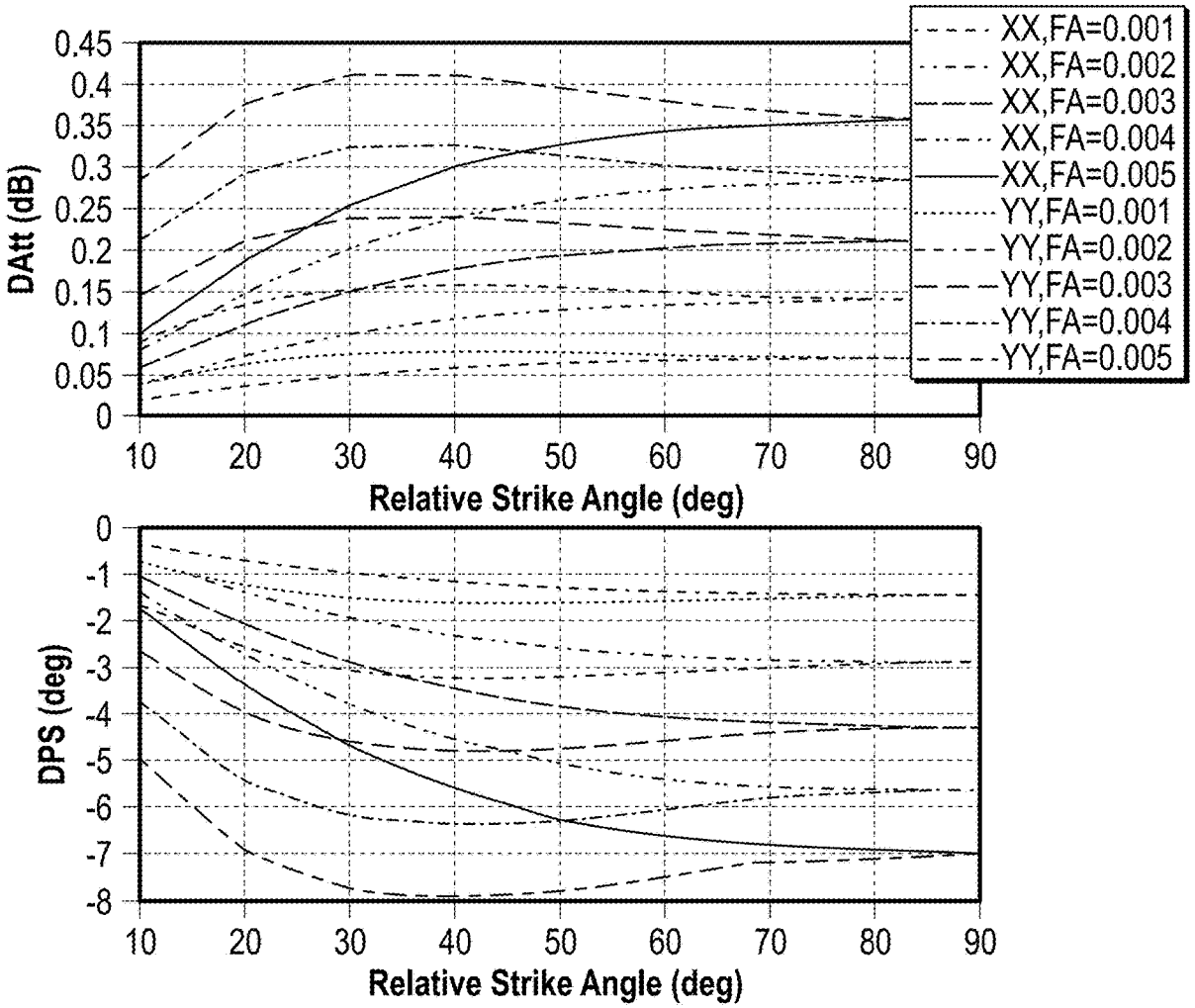
FIG. 27 shows the magnitudes of the step change in Att and PS of XZ−ZX response as the receiver R2 passing through the vertical fracture as function of fracture aperture (FA) and the relative strike angle θ of the fracture.
Figure 28:
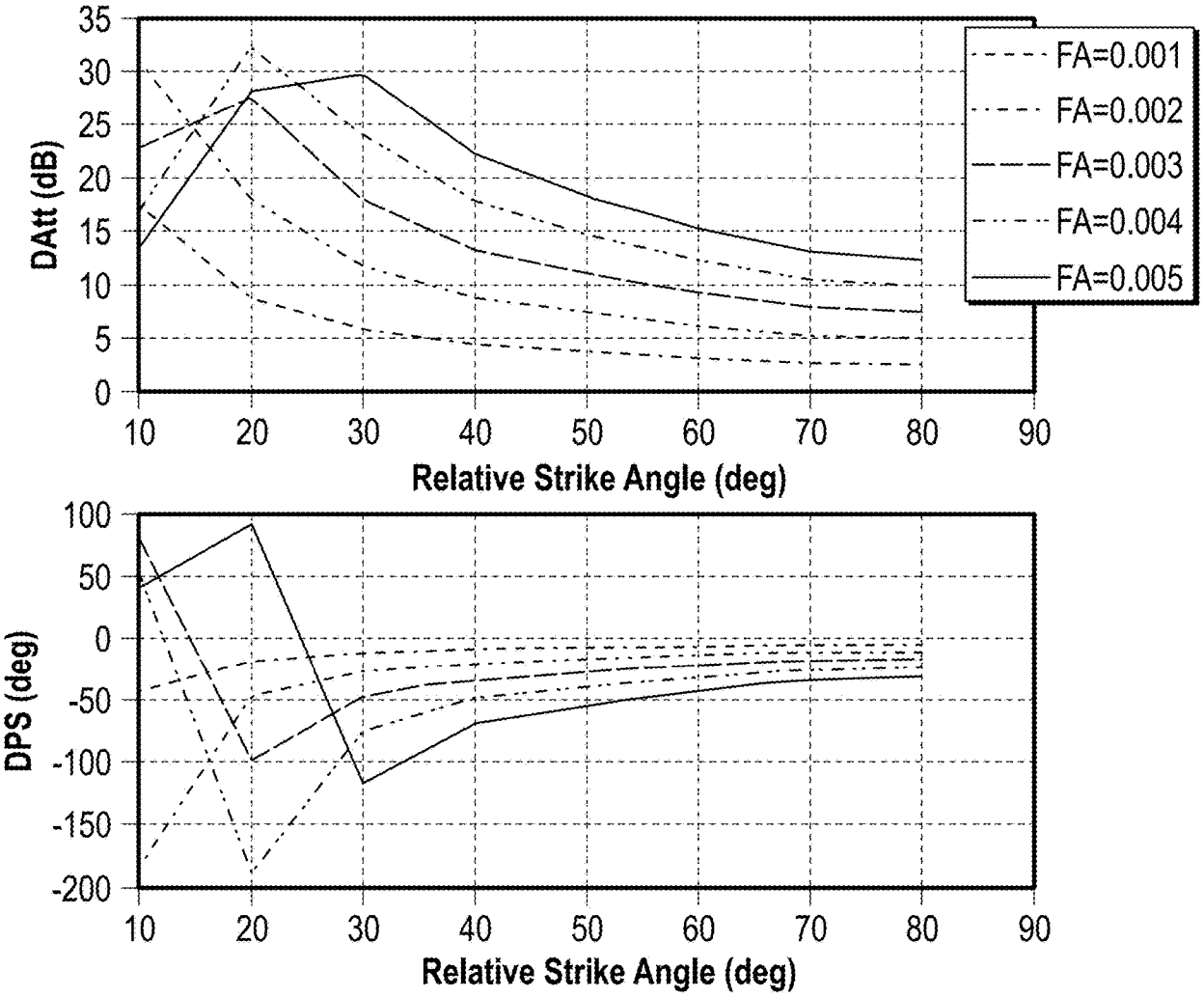
FIG. 28 shows the magnitudes of the step change in Att and PS of XZ−ZX responses as the receiver R2 passing through the vertical fracture as function of fracture aperture (FA) and the relative strike angle θ of the fracture.

To summarize the above modeling results, the magnitudes of the step change in Att and PS of the XX, YY responses as the receiver R2 passes through a vertical fracture as function of fracture aperture (FA) and the relative strike angle θ of the fracture are plotted in FIG. 27. The magnitudes of the step change in Att and PS of the XZ−ZX response as the receiver R2 passing through the vertical fracture as function of fracture aperture (FA) and the relative strike angle θ of the fracture are plotted in FIG. 28. These two plots demonstrate that propagation measurements have sufficient sensitivity for an inversion algorithm to solve for FA and relative strike angle θ. The magnitudes of the step change in the XX, YY, and XZ−ZX responses have a nearly linear relationship with respect to FA and a non-linear relationship with respect to θ. The sensitivity to θ variation is small when θ is near 90° and increases as θ became smaller (i.e., closer to parallel with the wellbore axis).

Figure 29:
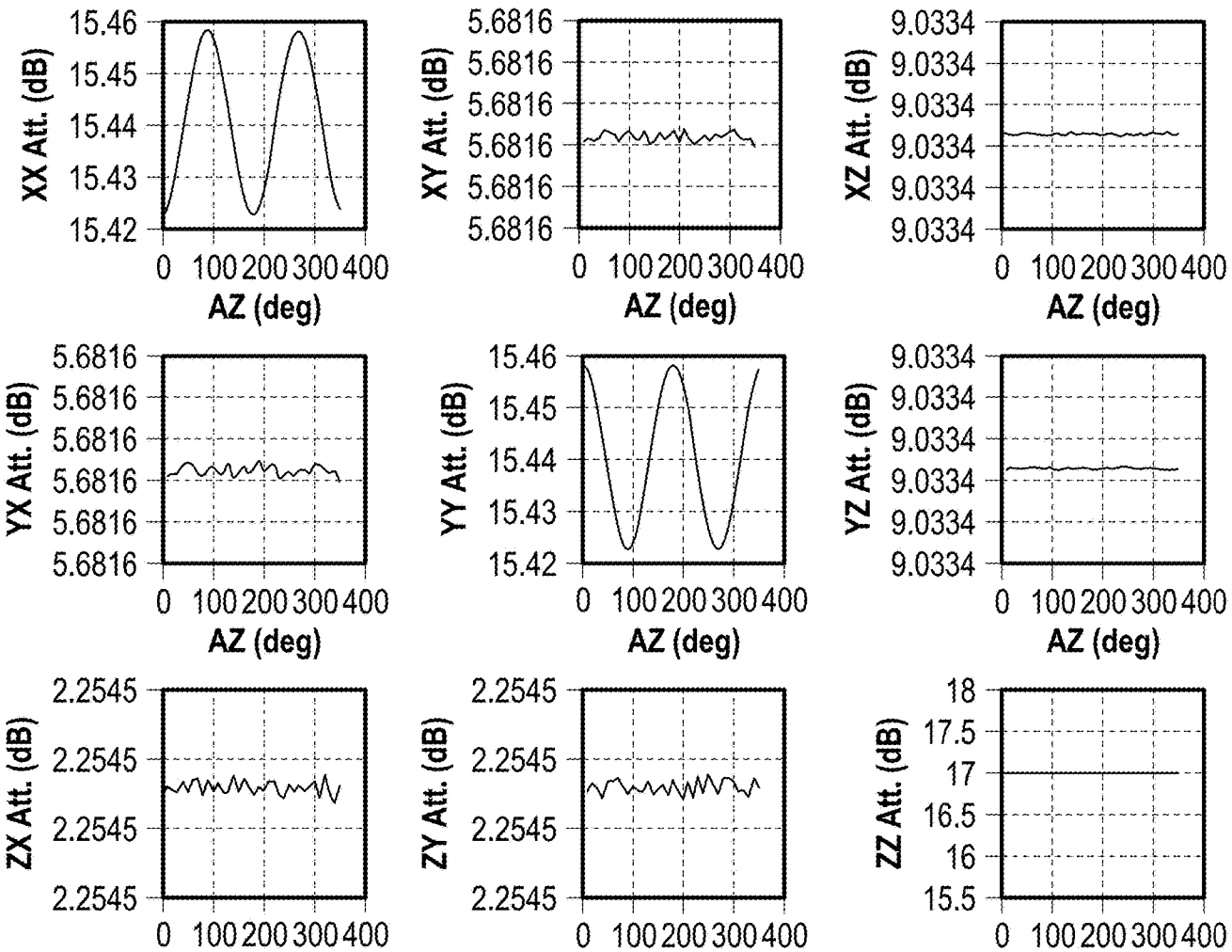
FIG. 29 shows attenuation responses as function tool rotation azimuth angle of a triaxial propagation tool moving horizontally through a large vertical fracture with relative strike angle of 60° and aperture 0.003 feet.

If the propagation measurements are implemented in LWD instruments, which may rotate around the z-axis of the instrument during drilling operations, one may optionally make instantaneous measurements of the XX, YY, ZZ, XZ, and ZX or take advantage of the rotation of the instrument by averaging of the azimuthally sampled data. For example, for the case of relative strike angle θ=60° and FA=0.003 feet (near the condition of FIG. 12 middle plot), at a distance of 7.1 feet from the fracture the Att measurements as a function of the instrument rotation azimuth angle, AZ, are shown in FIG. 29. The XX and YY signal components will have the following functional form:

$$D+A*\mathrm{COS}(2*AZ+B) \tag{1}$$

where D is the DC term and A is the amplitude of the second harmonic of AZ and B is related to the initial phase of the AZ with respect to the top-of-wellbore direction.

XX and YY have a 90° phase different between them. The coefficients D, A, and B may be obtained, for example, through a least square fitting algorithm of the azimuthal data to the above functional form.

The XX and YY responses may be obtained from the coefficients D and A

It can be shown that:

$$XX=D-0.5*A \tag{2}$$

$$YY=D+0.5*A \tag{3}$$

The off-diagonal terms of the Att and PS will be invariant with respect to AZ, that is, they will be substantially constant irrespective of the AZ value. In the present example, the XZ and ZX terms may be obtained by simply averaging the azimuthal data.

Based on the forgoing modeling results, the following example inversion method may be used to detect vertical fractures in horizontal well using either multiaxial (or a subset, triaxial) induction measurements or multiaxial (or a subset, triaxial) electromagnetic propagation measurements. The example inversion method will be described in general form first. A particular implementation that may make the inversion more robust to address certain sub-class of the background/fracture condition will also be discussed.

3. Inversion Method for Fracture Location, Fracture Aperture, and Fracture Strike Angle The example inversion may be performed for a selected window (i.e., measured depth range) of data. The data window as stated may be in the measured depth (MD) domain. An example window length may be fifty feet. The length of the inversion window may be adjusted. After the inversion is performed within a given window, the window may be advanced "downwardly" (i.e., along increasing MD) by a selected increment to a subsequent window, which may have the same MD length. The two successive windows may have a small overlap zone to account for the edge effects in the model, because the model assumes a uniform formation extending infinitely in both directions from the window end boundaries. The length of the overlap zone may be adjusted to provide suitable inversion results.

A model set of fractures crossing a wellbore to test the inversion is described with reference to FIG. 5. Within the inversion window, the formation is considered to be uniform, electrically anisotropic with resistivity described by a vertical and horizontal resistivity, Rh and Rv, respectively. The instrument is modeled to horizontally traverse through a series of vertical fractures at an angle θ with respect to the fracture plane. The model parameters to be inverted are:

(1) Fracture location of the i-th fracture—FL(i)

(2) Fracture aperture of the i-th fracture—FA(i)

(3) Fracture strike angle of the i-th FAZ(i)

(4) Optionally, the fracture resistivity of the i-th fracture—Rfrac(i)

wherein i=1, . . . , nf and of is the total number of fractures (5) Optionally, an averaged formation resistivity $Rh_a$ and $R_a$ within the inversion window may be determined by the inversion The model parameter description above is a general one. Some semi-analytic 1D model codes may only calculate results situations in which all the fractures in the inversion have the same strike angle. Some finite difference or finite element codes may be able to process full 3D geometry and therefore may calculate results the cases that each fracture has a different strike angle. Depending on the type of forward model used in the inversion process, the fracture strike angle of each fracture, FAZ(i), may or may not be required to be the same within a given inversion window.

Figure 30:
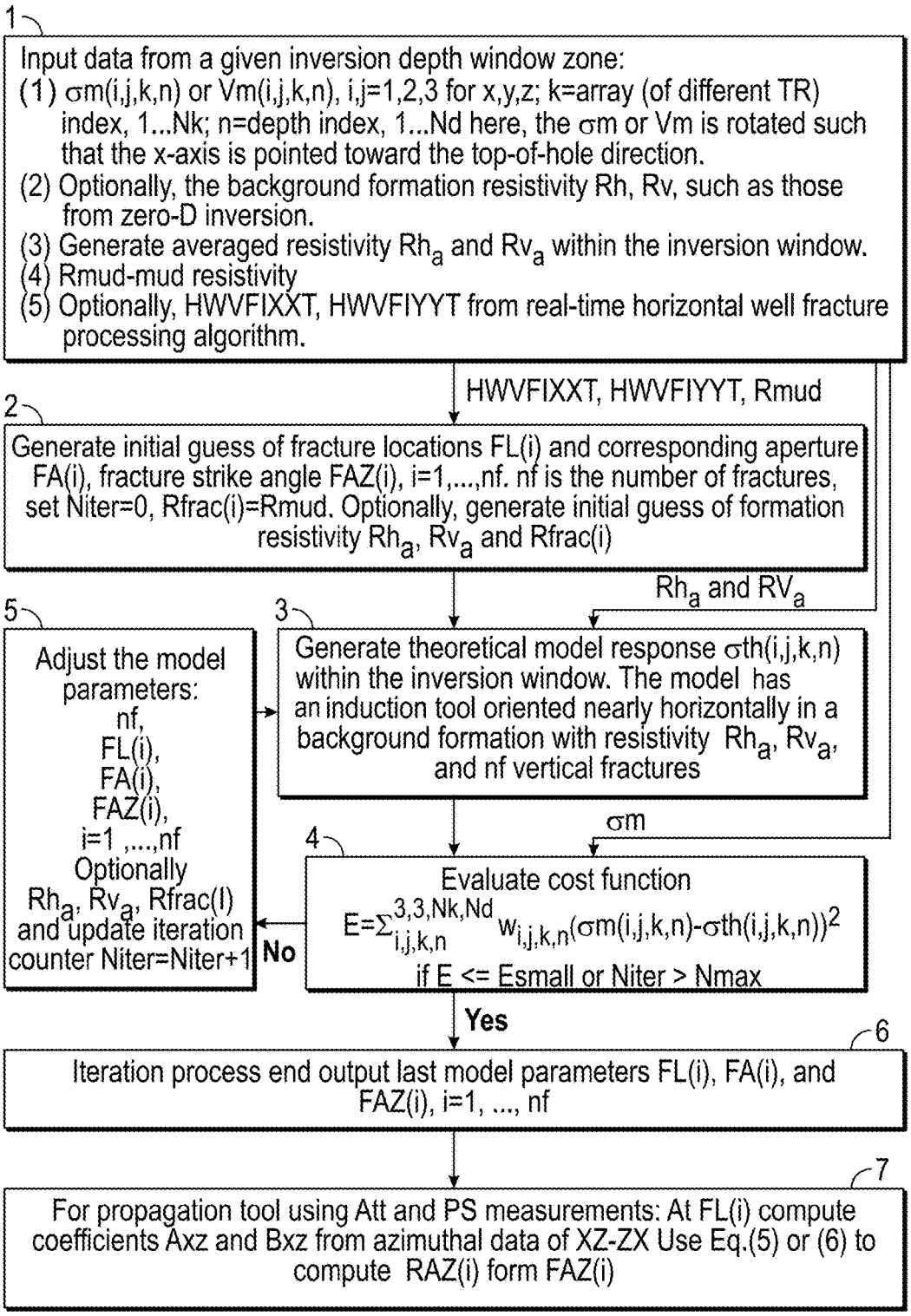
FIG. 30 shows a flow chart of an example inversion technique.

A flow chart of this method is shown in FIG. 30. The input data is described in block 1. The σm(i,j,k,n) or Vm(i,j,k,n), i,j=x,y,z, k=array (of different TR) index, n=depth index, represent the measured apparent conductivity tensor or transimpedance voltage from the $k^{th}$ TR spacing array measured at $n^{th}$ depth index location on the well path's axis. The i and j index with values from 1 to 3 representing the transmitter and receiver triaxial coil magnetic moment direction, x, y, z, respectively. The MD(n) is the measured depth of the well logging instrument on the well path at the $n^{th}$ sample index, n=1, . . . , ndepth. For the subsequent discussion, the algorithm will be described using the apparent conductivity tensor as an example input, knowing that Vm(i,j,k,n), or the attenuation and phase shift from the propagation tool Att(i,j,k,n) and PS(i,j,k,n) may also be used. For the different types of signal inputs, simply replace the σm(i,j,k,n) in the description below with Vm(i,j,k,n) or Att(i,j,k,n) and PS(i,j,k,n). The σm(i,j,k,n) here is the rotated apparent conductivity tensor such that the magnetic moment of the triaxial coils along the x-axis direction is pointing to the up or top-of-the hole direction.

In addition to the measured apparent conductivity tensor, the inversion method may optionally use input of the averaged background formation resistivity $Rh_a$ and $Rv_a$. Usually, the averaged formation resistivity $Rh_a$ and $Rv_a$ are available from the triaxial induction or propagation tools such as from Zero-D inversion (see, e.g., Wu, P., Wang, G., and Barber, T., 2010, *Efficient hierarchical processing and interpretation of triaxial induction data in formations with changing dip*, paper SPE 135442 presented at the SPE Annual Technical Conference and Exhibition, Florence, Italy, September 19-22). If the average Rh and Rv values are not available, the inversion may optionally invert for the foregoing two additional parameters $Rh_a$ and $Rv_a$. Generally, the mud resistivity Rmud is known or may be measured or estimated closely. For open fractures, it may be assumed that the fracture is filled with mud and therefore one may assign a fracture resistivity Rfrac(i)=Rmud. In this case, Rfrac(i) is not one of the parameters to be inverted. One may also optionally invert for Rfrac(i) to account for the condition that different material other than mud is in the fractures, such as in the case of a "healed" fracture.

A set of initial estimates of the fracture parameters is generated as shown in Block 2. Initial estimates of fracture parameters, in principle, could be set to arbitrary values know to be within a range of expected or reasonable values.

The inversion is expected to converge to the correct values. However, a set of initial estimated values close to the actual values would make the inversion much faster and also produce more robust answers. One effective way to obtain close initial estimates of the fracture parameters is to import fracture indicators, HWVFIXXT and HWVFIYYT from a real-time horizontal well fracture processing algorithm to be further explained below. For the propagation tool, one can employ the same method described using the XX and YY from Att and PS measurements of the propagation tool. With these two channels, one can obtain very close initial guess values for nf, FL(i), FA(i), i=1, . . . , nf. The initial guess for FAZ(i) could then be just starting at 90°, i.e., perpendicular to the well path.

An example algorithm for real time horizontal well fracture detection according to the present disclosure is described below. The input signals are represented by symbols σm(i,j,k,n), i,j=x,y,z, k=array (of different transmitter to receiver array [TR] spacing) index, n=depth index, represents the measured apparent conductivity tensor from the $k^{th}$ TR spacing array measured at $n^{th}$ depth (axial position) index location along the wellbore trajectory. The i and j index with values from 1 to 3 represent the transmitter and receiver triaxial coil magnetic moment direction x, y, z, respectively. The MD(n) is the measured depth of the instrument on the well path at the $n^{th}$ sample index, n=1, . . . , ndepth. The σm(i,j,k,n) in the present example is the rotated apparent conductivity tensor such that the magnetic moment of the x-axis direction magnetic dipole moment is pointing vertically upward or to the direction of the gravitational top of the wellbore.

First derivatives of the XX and YY components of σm(i, j,k,n) are estimated with respect to the depth index"

$$\sigma mxx(k,n)=\sigma m(1,1,k,n)$$

$$\sigma myy(k,n)=\sigma m(2,2,k,n)$$

Let dσmxx(k,n)/dMD and dσmyy(k,n)/dMD be the first derivative of σmxx(k,n) and σmyy(k,n) with respect to depth, MD, for each receiver array k, respectively. There are many methods to compute the derivative of a function with respect to selected variables. The exact detail of the method is not essential so long as the MD position of the drop in the value of σmxx(k,n) and σmyy(k,n) as illustrated by the model data described above is identified. For example, one may use a single sided forward difference with a 3-sample shift. Other variations of the method may work as well. The foregoing presumes that the measurements are recorded or obtained as discrete samples at points along the well trajectory each assigned a value of MD, as explained above.

Significant peaks in dσmxx(k,n)/dMD and dσmyy(k,n)/dMD are identified and the peak signal amplitudes and axial positions thereof are determined.

Let PAxx(k,i), PLxx(k,i) k=1, . . . , narray, i=1, . . . , nxxpeak be the peak amplitude and peak amplitude axial location of dσmxx(k,n)/dMD:

$$PAxx(k,i)=d\sigma mxx(k,ixxpk)/dMD$$

$$PLxx(k,i)=MD(ixxpk)$$

where ixxpk is the i-th depth index such that dσmxx(k, ixxpk−1)<dσmxx(k,ixxpk)>dσmxx(k,ixxpk+1) and PAxx (k,i)>PAcut.

Let PAyy(k,j), PLyy(k,j), k=1, . . . , narray, j=1, . . . , nyypeak be the peak amplitude and peak location of dσmyy (k,n)/dMD $$PAyy(k,j)=d\sigma mxx(k,jyypk)/dMD$$

$$PLyy(k,j)=MD(jyypk)$$

where jyypk is the j-th depth index such that dσmxx(k, jyypk−1)<dσmxx(k,jyypk)>dσmxx(k,jyypk+1) and PAyy (k,j)>PAcut.

The PAcut in the above expressions is a threshold value above which the peaks in dσmxx(k,n) and dσmyy(k,n) are considered indicative of a fracture. The value of PAcut may be empirically determined or may be determined from modeling results such as described above.

There are many known algorithms for determining peaks of given functions. Again, the exact details of the peak finding algorithm is not to be construed as a limitation on the scope of the present disclosure. Many different versions would work as well. The threshold value PAcut is designed to exclude certain noise peaks that may occur in actual wellbore measurement data so that the calculated results will appear less cluttered. Determining and applying PAcut to the calculations of the signal amplitudes is not essential because the peak value for large fractures will usually be observable and thus determinable above the noise if all the signal amplitude peaks are evaluated. Without the PAcut filtering, there is substantially no risk of failure to detect large fractures.

Results are displayed such that the fracture locations and the associated fracture aperture indications may be identified together with the input measurements σmxx, σmyy, and σmzz as quality control information. Here σmzz=σm(3,3, k,n).

The values of PAxx(k,PLxx(k,i)) and PAyy(k,PLyy(k,j)) may be plotted out as logs (curves with respect to measured depth MD) for a given receiver array k. Define the following names, HWVFIXX(k) and HWVFIYY(k), for the foregoing two log curves First, initialize the foregoing two log curves with zeroes at each depth sample:

$$HWVFIXX(k,n)=0,\ n=1,\ \ldots,\ n\text{depth}$$

$$HWVFIYY(k,n)=0,\ n=1,\ \ldots,\ n\text{depth}$$

Then, reassign their values at the depth PLxx(k,i) and PLxx(k,i)

$$HWVFIXX(k,ixxpk)=PAxx(k,PLxx(k,i))$$

$$HWVFIYY(k,iyypk)=PAyy(k,PLyy(k,j))$$

The parameter HWVFIXX is defined as a Horizontal Well Vertical Fracture Indicator from the XX signal component. The HWVFIYY is defined as a Horizontal Well Vertical Fracture Indicator from the YY signal component.

The foregoing two components of a fracture indicator will have zero values everywhere except at depths where the dσmxx(k,n)/dMD and dσmyy(k,n)/dMD have a significant non-zero peak. The amplitude of the non-zero values are the peak values of the derivative dσmxx(k,n) and dσmyy(k,n). The peak values of the derivatives are proportional to the sharp drop distance traversed by the XX and YY components which in term are proportional to the fracture aperture as was determined from the modeling response explained above. The values of the HWVFIXX and HWVFIYY indicators thus obtained are quantitative indications of the fracture locations and qualitative indications of the fracture apertures. In a constant background resistivity formation, which frequently is the case for a wellbore drilled along the bedding plane of a fractured shale formation, the amplitude of HWVFIXX and HWVFIYY at various fracture locations accurately reflects the relative fracture aperture. The fracture locations indicated by HWVFIXX and HWVFIYY are the main receiver R locations of the k-th receiver array associated with the measurement depth of the σm(i,j,k,n) signals. If the measurement depth of the σm(i,j,k,n) signals is defined as the measurement depth of the transmitter, then the true measured depth of the fracture should be deeper than HWVFIXX and HWVFIYY by the transmitter to main receiver R axial distance. The true measured depth of the fractures will be indicated by:

$$HWVFIXXT=HWVFIXX(k,ixxpk+D2(k)/dsi)$$

$$HWVFIYYT=HWVFIYY(k,iyypk+D2(k)/dsi)$$

Where D2(k) is the distance between the transmitter and the main receiver R for the k-th receiver array and dsi is the depth sampling interval. The depth shifted HWVFIXXT and HWVFIYYT channels stand for Horizontal Well Vertical Fracture Indicator from XX and YY components with True depth, respectively.

Model responses σth(i,j,k,n) within the inversion window are generated, as shown in Block 3. The model has an induction tool or propagation tool oriented nearly horizontally in a background formation with resistivity $Rh_a$, $Rv_a$ and of vertical fractures.

The difference between the measured apparent conductivity tensor σm(i,j,k,n) within the inversion window and the theoretical modeled instrument response σth(i,j,k,n) are evaluated, as shown in Block 4. The difference may be expressed as a cost function. One may construct a cost function as the L2 norm between the measured data and theoretical data such as E below:

$$E=\Sigma_{i,j,k,n}^{3,3,Nk,Nd} wi,j,k,n(\sigma m(i,j,k,n)-\sigma th(i,j,k,n))2$$

Other means to express the cost functions such as the L1 norm, etc., may also be used as well. The values wi,j,k,n in the above cost function expression are the weights in the inversion that may be used to control the relative importance of each input components in the overall cost function. The weights may also be used to turn off certain components by setting the value of the weight of such components to zero.

The value of the cost function at each iteration will be compared with a predefined threshold value Esmall below which the inversion is considered converged, namely the difference between measured instrument responses and the modeled instrument responses is small enough that the model parameters may be considered to be the true values.

If the cost function is larger than Esmall, the inversion directs the processing to Block 5 where the model parameters may be adjusted and the new model parameters will be used in 4 again to start another iteration loop, and the loop counter Niter is also updated. Many techniques are known in the art that describe how to adjust the model parameters in the foregoing iteration process. Representative examples are described in Levenberg, K. "A Method for the Solution of Certain Problems in Least Squares.", Quart. Appl. Math. 2, 164-168, 1944, Marquardt, D. W., "An Algorithm for Least-Squares Estimation of Nonlinear Parameters", J. Soc. Ind. Appl. Math., Vol II, No. 2., pp. 431-441 (1963), and Bjorck, A. (1996). Numerical methods for least squares problems. SIAM, Philadelphia. ISBN 0-89871-360-9.

In the iteration loop, If E<=Esmall or Niter>Nmax, the inversion will terminate and exit the iteration loop. At such time the model parameters defined in the latest iteration are determined as the inversion results. If Niter>Nmax, which may be a predefined large number above which the iteration processing is considered taking too long to converge or not converging, a flag may be set indicating non-convergent answers.

For the LWD instrument implementation, the compensated attenuation and phase shift measurements, Att(i,j) and PS(i,j), from the propagation instrument may be chosen as the measurement inputs. The off-diagonal terms of Att(i,j) and PS(i,j), i≠j, will be invariant with respect to the apparent instrument azimuth angle as the tool turns around its axis. Therefore the measurements may not differentiate between sharp and obtuse relative strike angle of the fracture. To obtain that differentiation capability, one may use one of the original measurements $V_{T1R1}$(i,j), $V_{T1R2}$(i,j), $V_{T2R1}$(i,j), or $V_{T2R2}$(i,j) to help make the sharp or obtuse relative strike angle determination. Unlike the compensated measurements, these measurements may contain errors due to the drift of the transmitter and receiver gains. However, in the present case the inversion process is not relying on the absolute amplitude to help determine the sharp or obtuse relative strike angle, rather the inversion uses the sign of these measurements as a function of the tool azimuthal angle.

Figure 31:
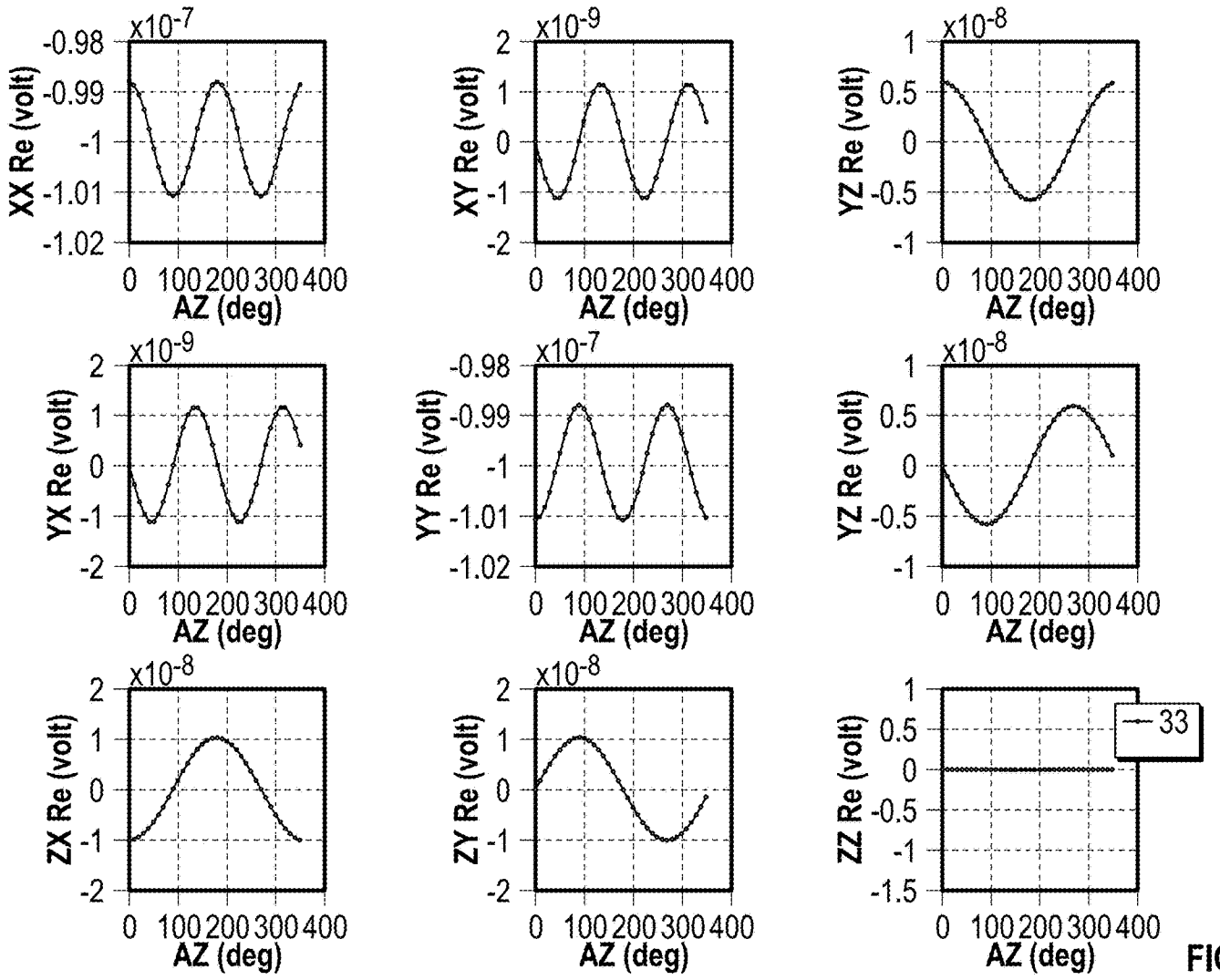
FIG. 31 shows response of transimpedance voltage tensor $V_{T1R1}$ as function of tool rotation azimuth for T1 to R1 measurements at MD=7.5 ft. where the first receiver R1 just crosses the fracture which is located at MD=10 ft.

FIG. 31 shows the response of transimpedance voltage tensor $V_{T1R1}$ as function of tool rotation azimuth (AZ) for T1 to R1 measurements at MD=7.5 ft. where the R1 just crosses the fracture which is located at MD=10 ft. The ZZ term contains only DC term. The XZ and YZ terms are out of phase with each other by 90°. Similarly, ZX and ZY are out of phase with each other by 90°. For LWD measurements, the XZ and ZX responses may be considered sampled at random AZ angles as represented by those red dots. One may define a the real part of the XZ−ZX measurement as:

$$RXZMZX=\text{Real}(XZ-ZX)=Axz*\text{COS}(AZ+Bxz) \quad (4)$$

Here Axz and Bxz are the coefficients obtained by a least square fitting the measured azimuthal data to the functional form in Equation (4). Axz is the amplitude of the first cosine component and Bxz is related to the initial tool phase angle. The sign of RXZMZX at AZ=0 would be the indication of whether the inverted relative strike angle from algorithm in Ref. 10 is sharp or obtuse. One example means to discriminate the sharp versus obtuse relative strike angle is given below:

If $Axz*\text{COS}(Bxz)>0$ $RSA=FAZ$, else $RSA=FAZ+90°$; End (5)

Here, RSA is the relative strike angle and FAZ is the inverted fracture strike angle.

Similar results may also be obtained from the imaginary part of the XZ−ZX. In fact, similar results may be obtained by using the real or the imaginary part of XZ, ZX, YZ, ZY, or YZ−ZY. In the present example just use the real part of XZ−ZX may be used to demonstrate the method of differentiating the sharp or obtuse angle.

Figure 32:
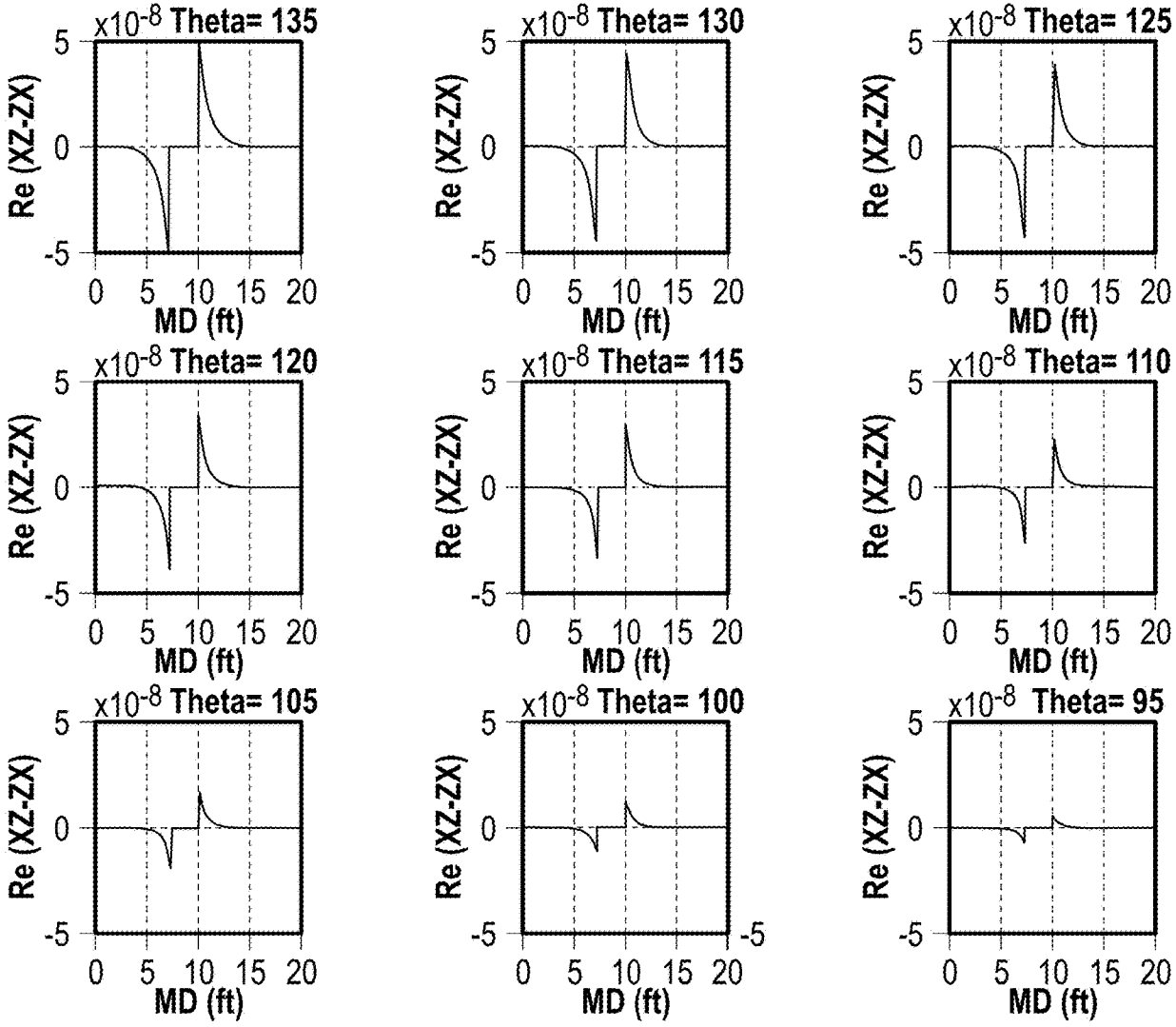
FIG. 32 shows the response of XZ−ZX to a vertical fracture at MD=10 ft. with relative strike angle θ varies from 135° to 95° in steps of 5°.
Figure 33:
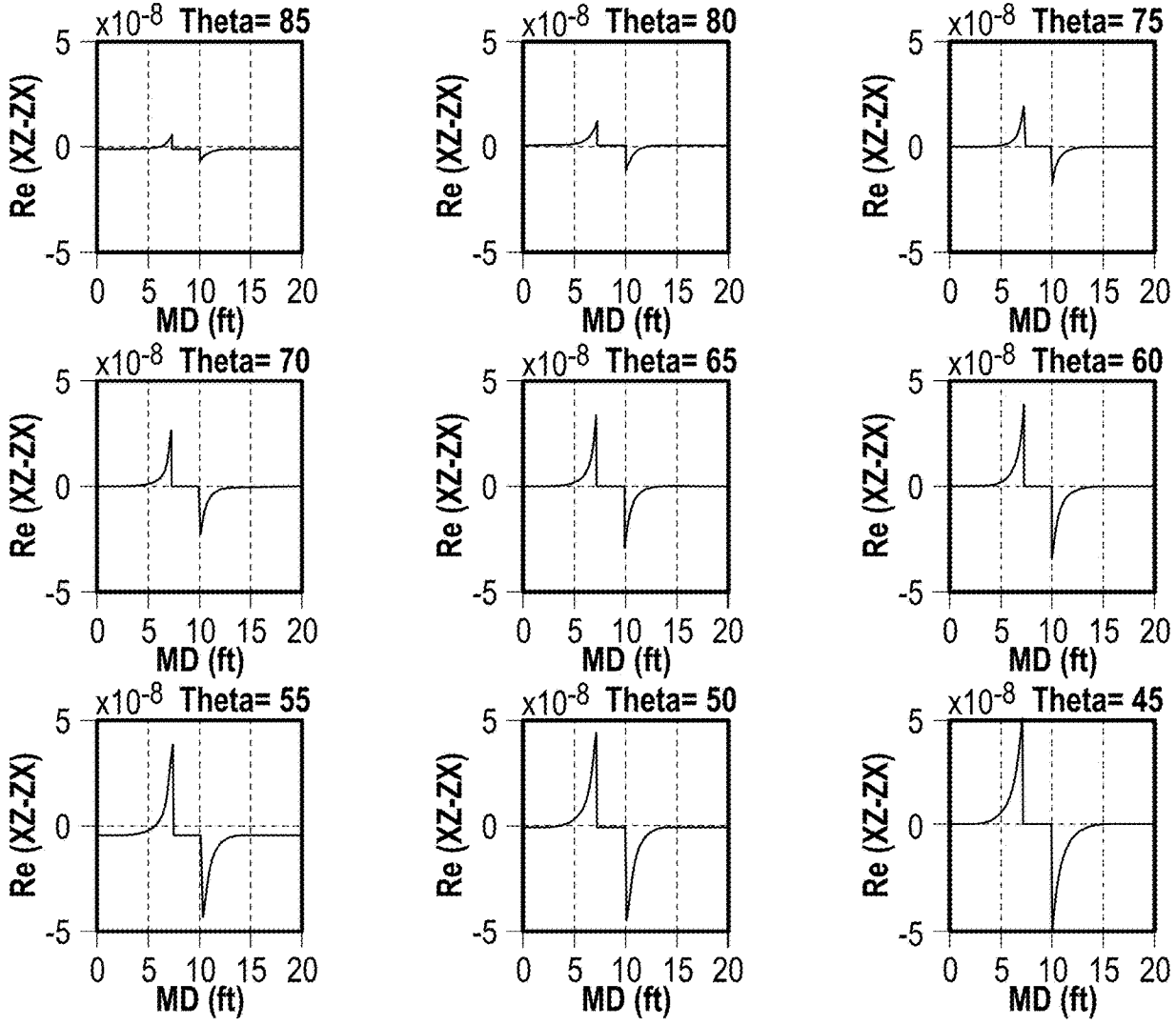
FIG. 33 shows the response of XZ−ZX to a vertical fracture at MD=10 ft. with relative strike angle θ varies from 85° to 45° in steps of 5°.

The above sign response of the XZ−ZX in equation (5) is based on the receiver R1 crossing the fracture. As the instrument continues to proceed forward till the transmitter T1 also crosses over the fracture, the sign would flip. Therefore, we can also discriminate the sharp versus obtuse relative strike angle by keying on the polarity of the second pulse (the first pulse being R1 crossing the fracture as illustrated in FIGS. 32 and 33 with the opposite sign:

If $Axz*\text{COS}(Bxz)<0$ (second pulse logic)

$RSA=FAZ$

Else $Rsa=Faz+90°$

End (6)

FIGS. 32, and 33, show the modeled responses of RXZMZX demonstrating the relationship between the first pulse (R1 crossing fracture) and the second pulse (T1 crossing fracture which comes exactly $D_{T1R1}$ ft. later) from fractures with obtuse and sharp relative angle, respectively. For all cases, a fracture is located at MD=10 ft. crossing the well path with different relative strike angles. FIG. 33 contains the cases of obtuse relative strike angles. It has 9 subplots for responses of RXZMZX for relative strike angle from 135° to 95° in 5° decrement. FIG. 33 contains the cases of sharp relative strike angles. It has 9 subplots for responses of RXZMZX for relative strike angle from 85° to 45° in 5° decrement.

In homogeneous anisotropic formation, the RXZMZX will normally have zero value. As the tool is approaching the fracture at an obtuse angle, RXZMZX will gradually move to negative value. When the receiver R1 is crossing the fracture, the RXZMZX would have an abrupt rise from negative value back to zero. The RXZMZX will maintain zero value when the fracture is straddle between transmitter T1 and receive R1. When the T1 is crossing the fracture, the RXZMZX will have a sharp rise to a positive value and then gradually tapers back to zero as the transmitter T1 is moving away from the fracture. Therefore, the RXZMZX appears to have two sharp pulses, one from negative to zero for R1 crossing and the other from zero to positive for T1 crossing. The separation between these two pulses is exactly the transmitter to receiver distance $D_{T1R1}$.

For a sharp relative fracture strike angle (FIG. 33), the polarity of these two pulses would flip sign with respective to the cases of obtuse relative fracture strike angle (FIG. 32). The R1 crossing pulse becomes positive while the T1 crossing pulse become negative.

If one uses the Att and PS from propagation tool as inputs, differentiating whether the relative fracture angle is sharp or obtuse and outputting RSA(i) instead of FAZ(i) as the relative strike angle of the fractures may be performed as shown in Block 7.

Special Implementations to Improve Robustness 4.1 Known Uniform Formation Option Horizontal well sections are generally drilled through thousands of feet of the same formation. Therefore, it makes sense to assume the formation is uniform with known horizontal and vertical resistivity, Rha and Rva. In this way, the inversion just inverts for fracture parameters nf, FL(i), FA(i), and FAZ(i), i=1, . . . , nf. The Rha and Rva values usually are available through a Zero-D inversion.

4.2 Not Inverting for Fracture Location Option

The XX, YY, XZ–ZX may produce a very accurate fracture location indicator.

One option is to not invert for the fracture location and only invert for the fracture aperture and the fracture strike angle. This would make the inversion operate faster and make the results more robust. This option may especially useful for real-time application, i.e., while the LWD instrument is drilling a wellbore.

4.3 Fractures within Inversion Window Have the Same Strike Angle Option

To allow multiple fractures within the inversion window to have different strike angles requires 3D code as the forward model engine to generate the theoretical responses. 3D code represents a computational burden to the inversion. The fractures in a given area may have a similar strike angle within a large depth range. Therefore, the assumption that fractures within the inversion window, which could be controlled to be sufficiently small, have the same relative strike angle with respective to the well path may be used. Using this assumption, a much faster 1D code can be used to generate the modeled instrument responses.

4.4 A Single Fracture within the Inversion Window Option

To accommodate the condition that adjacent fractures have different strike angles and without invoking a 3D forward modeling code, one may adjust the inversion window length such that there is only one fracture centered within the window. In this way, one may invert for the fracture aperture and strike angle for each individual fracture that is reasonably separated from its neighboring fractures.

4.5 Inverting for Fracture Resistivity Option

One may optionally invert for the fracture resistivity Rfrac(i) to allow for the condition of healed fractures which may have different resistivity than Rmud.

4.6 Inverting for Fracture Parameters using Induction Measurements Option

One may optionally invert for the fracture parameters FL(i), FA(i), and FAZ(i), i=1, . . . , nf, using the induction measurements σm(i,j,k,n) or Vm(i,j,k,n).

4.7 Inverting for Fracture Parameters using Propagation Measurements Option

One may optionally invert for the fracture parameters FL(i), FA(i), and RSA(i), i=1, . . . , nf, using the propagation measurements Att(i,j) and PS(i,j) and Vm(i,j,k,n).

4.8 Using the Inversion Results to Steer a Well Path for Perpendicular Fracture Intersection An example inversion model is described above with reference to FIG. 30. Within the inversion window, the formation is considered to be uniformly anisotropic with resistivity described by Rh and Rv. The well logging instrument is assumed to traverse horizontally through a series of large vertical fractures in the formation each at an angle θ with respect to the fracture plane. The model parameters to be inverted for are:

(1) Fracture location of the i-th fracture–FL(i)

(2) Fracture aperture of the i-th fracture–FA(i)

(3) Fracture strike angle of the i-th FAZ(i)

Figure 34:
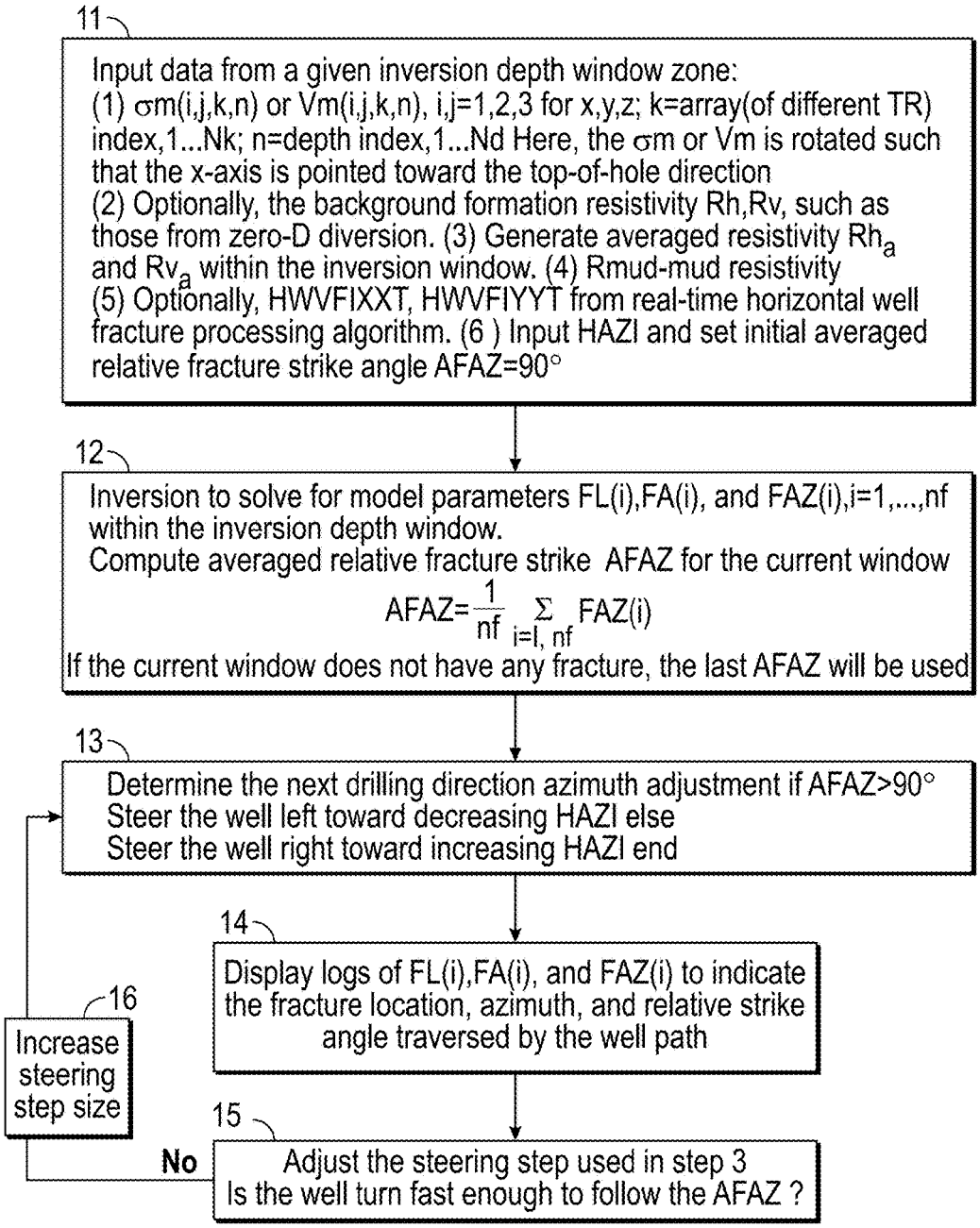
FIG. 34 shows a flow chart of an example well steering method.

(4) Optionally, fracture resistivity of the i-th fracture–Rfrac(i)

i=1, . . . , nf and of is the total number of fractures (5) Optionally, averaged formation resistivity $Rh_a$ and $Rv_a$ within the inversion window A flow chart of this well steering method is shown in FIG. 34. The input data are described in block 11. The σm(i,j,k,n) or Vm(i,j,k,n), i,j=x,y,z, k=array (of different TR) index, n=depth index, represent the measured apparent conductivity tensor or transimpednace voltage from the $k^{th}$ TR spacing array measured at $n^{th}$ depth index location on the well path's axis. The i and j index with values from 1 to 3 representing the transmitter and receiver triaxial coil magnetic moment direction x, y, z, respectively. The MD(n) is the measured depth (axial position) of the well logging instrument on the well path at the $n^{th}$ sample index, n=1, . . . , ndepth. For the subsequent discussion, the algorithm may be described using the apparent conductivity tensor as an example input knowing that Vm(i,j,k,n), or the attenuation and phase shift from an electromagnetic propagation tool Att(i,j,k,n) and PS(i,j,k,n) may be used as well. For these alternative inputs, simply replace the σm(i,j,k,n) in the description below with Vm(i,j,k,n) or Att(i,j,k,n) and PS(i,j,k,n). The σm(i,j,k,n) here is the rotated apparent conductivity tensor such that the magnetic moment of the triaxial coils that points to x-axis direction is pointing to the up or top-of-the hole direction.

In addition to the measured apparent conductivity tensor, the method optionally may use input of averaged background formation resistivity $Rh_a$ and $Rv_a$. The averaged formation resistivity $Rh_a$ and $Rv_a$ may be obtained from measurements made by the triaxial induction or propagation tools such as from Zero-D inversion. If the foregoing data are not available, the inversion could optionally invert for two additional parameters $Rh_a$ and $Rv_a$. Generally, the drilling fluid ("mud") resistivity Rmud is known or may be estimated closely. For open fractures, it is assumed that the fracture is filled with mud and therefore assign fracture resistivity Rfrac(i)=Rmud. In this case, Rfrac(i) is not part of the parameters to be inverted. One may also optionally invert for Rfrac(i) to account for the condition that different material other than mud is disposed in the fractures, such as in the case of a "healed" fracture.

The parameter HAZI is the borehole azimuth angle and one may initialize the averaged relative fracture strike angle to 90°, AFAZ=90°.

The next action as show in block 12 is to invert for fracture parameters within the inversion window, FL(i), FA(i), and FAZ(i) i=1, . . . , nf, using the algorithm described above with reference to FIG. 30. Here, FL(i), FA(i) and FAZ(i) are the inverted fracture location, aperture, and relative strike angle for the ith fracture, respectively. The averaged relative strike angle AFAZ within the inversion window may be computed using the expression:

$$AFAZ = \frac{1}{nf}\sum_{i=1,nf} FAZ(i)$$

If within the current inversion window, there is no fracture found, the value of AFAZ from the previous inversion window may be used as the current value for AFAZ.

The next action, shown in block 13, is to use the value of AFAZ value to steer the well.

If AFAZ>90°, the well path should be steered left so as to decrease the HAZI direction. If AFAZ<90°, the well path should be steered right to increase the HAZI direction. Here right and left are defined with respect to facing the direction of drilling, i.e., in the increasing direction of MD.

The next action as shown in block 14 is to display the fracture parameters FL(i), FA(i) and FAZ(i) as function of MD. This display may enable the user to observe the fracture orientation in the most recent inversion windows.

Based on the display in 14, at 15 the inversion procedure may include a check whether the current steering adjustment, if any, is adequate to follow the AFAZ variation. If not, an adjustment command could be sent to enable, at 13, increasing the amount of the steering performed. For purposes of the present disclosure, steering the well path may be performed using any directional drilling apparatus or system known in the art, including, without limitation, whipstocks, steerable drilling motors and rotary steerable directional drilling systems.

Figure 35:
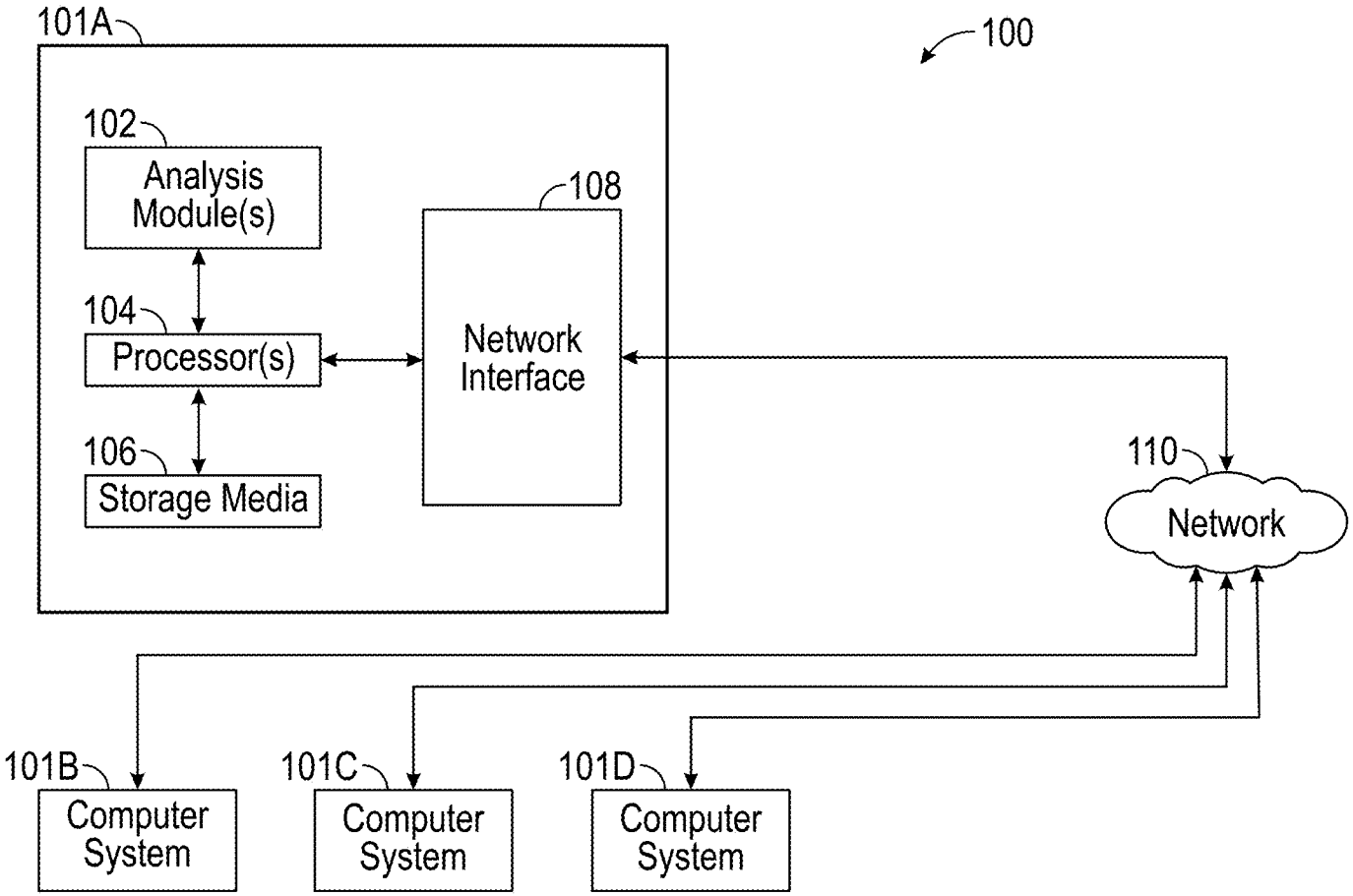
FIG. 35 shows an example computer system that may be used in some embodiments.

FIG. 35 shows an example computing system 100 in accordance with some embodiments. The computing system 100 may be an individual computer system 101A or an arrangement of distributed computer systems. The computer system 101A may include one or more analysis modules 102 that may be configured to perform various tasks according to some embodiments, such as the tasks depicted in FIGS. 30 and 34. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at a well drilling location, e.g., in the surface control unit 70 in FIG. 1, while in communication with one or more computer systems such as 101C and/or 101D that may be located in one or more data centers on shore, aboard ships, and/or located in varying countries on different continents).

A processor can include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 35 the storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 35, and/or computing system 100 may have a different configuration or arrangement of the components depicted in FIG. 34. The various components shown in FIG. 35 may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for drilling a wellbore, comprising:

drilling a well along a path substantially along a bedding direction of a selected subsurface formation having at least one substantially vertical fracture therein;

determining a geometric parameter of the at least one substantially vertical fracture based on electromagnetic signals received in an instrument in the wellbore, wherein determining the parameter comprises:

estimating the parameter of the at least one substantially vertical fracture;

determining an expected response of an instrument using an initial model of the formation including the fracture having the estimated parameter;

measuring a measured response of the instrument using the electromagnetic signals; and adjusting the parameter, another geometric parameter of the at least one substantially vertical fracture, or both, based on a comparison of the expected response and the measured response;

adjusting a direction of the path based on the determined at least one parameter;

determining an existence of a plurality of fractures in a selected inversion measured depth window;

determining an average of directions of the determined existing fractures with respect to the well path direction; and adjusting the path of the wellbore so that the path is substantially perpendicular to the average of directions.

2. The method of claim 1 wherein estimating an initial orientation of the at least one substantially vertical fracture with respect to the axis of the wellbore and a distance from the fracture to a position where electromagnetic measurements were obtained by receiving the electromagnetic signals;

and repeating determining the expected response, and comparing the expected response to the measured response until a difference between the expected response and the measured response either falls below a selected threshold or a number of repetitions thereof-exceeds a predetermined number; and displaying the model after or displaying an indication of non-convergence.

3. The method of claim 2 wherein the determining the initial orientation and the distance comprises:

calculating a first derivative with respect to wellbore depth of the multiaxial electromagnetic induction measurements;

determining at least one peak and an amplitude thereof of the first derivatives; and using the peak and the amplitude to determine the location by displaying the first derivatives with respect to wellbore depth.

4. The method of claim 3 further comprising selecting a threshold value for amplitude and excluding from evaluation any peak in the first derivatives with respect to wellbore depth.

5. The method of claim 2 wherein two mutually orthogonal axes are rotated such that one thereof is in a vertical direction.

6. The method of claim 2 further comprising accepting as input to the multiaxial electromagnetic measurements at least one additional receiver spacing from the transmitter and determining the parameter of the at least one substantially vertical fracture using the additional receiver spacing.

7. The method of claim 2 further comprising displaying the input electromagnetic measurements in depth correspondence with first derivatives thereof as a quality control indication.

8. The method of claim 2 wherein the electromagnetic measurements comprise electromagnetic induction measurements.

9. The method of claim 2 wherein the electromagnetic measurements comprise electromagnetic propagation measurements.

10. The method of claim 9 wherein the electromagnetic measurements are acquired while an electromagnetic propagation well logging instrument is rotated.

11. The method of claim 2 wherein the measurements comprise multiaxial electromagnetic measurements made along two mutually orthogonal axes perpendicular to and parallel to an axis of the wellbore, the measurements corresponding to at least one receiver spacing from a transmitter.

12. The method of claim 1 wherein the adjusting a direction of the well path comprises operating a directional drilling device.

13. The method of claim 12 wherein the directional drilling device comprises a steerable drilling motor.

14. The method of claim 12 wherein the directional drilling device comprises a rotary steerable directional drilling system.

15. The method of claim 1 wherein determining the geometric parameter of the at least one substantially vertical fracture occurs prior to drilling therethrough.

16. A system for drilling a wellbore, comprising:

a directional drilling device coupled to a drill string having a drill bit at a longitudinal end thereof; and an instrument configured to determine a direction of fractures in a formation, wherein the instrument includes a processor configured to perform operations comprising:

determining a geometric parameter of the at least one substantially vertical fracture based on electromagnetic signals received in an instrument in the wellbore, wherein determining the parameter comprises:

estimating the parameter of the at least one substantially vertical fracture;

determining an expected response of an instrument using an initial model of the formation including the fracture having the estimated parameter;

measuring a measured response of the instrument using the electromagnetic signals;

adjusting the parameter, another geometric parameter of the at least one substantially vertical fracture, or both, based on a comparison of the expected response and the measured response; and calculating a first derivative with respect to wellbore depth of multiaxial electromagnetic induction measurements;

determining at least one peak and an amplitude thereof of the first derivatives; and using the peak and the amplitude to determine the location by displaying the first derivatives with respect to wellbore depth.

17. The system of claim 16 wherein the operations further comprise:

estimating the parameter comprises determining an initial orientation of the at least one substantially vertical fracture with respect to the axis of the wellbore and a distance from the fracture to a position where electromagnetic measurements were obtained by receiving the electromagnetic signals;

adjusting the parameter comprising adjusting the parameter and repeating determining the expected response, and comparing the expected response to the measured response until a difference between the expected response and the measured response either falls below a selected threshold or a number of repetitions thereof exceeds a predetermined number; and displaying the model after or displaying an indication of non-convergence.

18. The system of claim 16 wherein the directional drilling device comprises a steerable drilling motor.

19. The system of claim 16 wherein the directional drilling device comprise a rotary steerable directional drilling system.

* * * * *